US007442405B2

(12) United States Patent
Miyamoto et al.

(10) Patent No.: US 7,442,405 B2
(45) **Date of Patent: *Oct. 28, 2008**

(54) METHOD FOR PRODUCTION OF ELECTRON SOURCE SUBSTRATE PROVIDED WITH ELECTRON EMITTING ELEMENT AND METHOD FOR PRODUCTION OF ELECTRONIC DEVICE USING THE SUBSTRATE

(75) Inventors: Masahiko Miyamoto, Kanagawa-ken (JP); Mitsutoshi Hasegawa, Kanagawa-ken (JP); Kazuhiro Sando, Kanagawa-ken (JP); Kazuya Shigeoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 581 days.

This patent is subject to a terminal disclaimer.

(21) Appl. No.: 10/853,762

(22) Filed: May 26, 2004

(65) Prior Publication Data

US 2004/0213897 A1 Oct. 28, 2004

Related U.S. Application Data

(60) Continuation of application No. 10/265,264, filed on Oct. 7, 2002, now abandoned, which is a division of application No. 09/044,016, filed on Mar. 19, 1998, now Pat. No. 6,514,559.

(30) Foreign Application Priority Data

Mar. 21, 1997 (JP) ..... 9-085547
Mar. 17, 1998 (JP) ..... 10-085065

(51) Int. Cl.
*B05D 5/12* (2006.01)

(52) U.S. Cl. ..... 427/77; 427/78

(58) Field of Classification Search ..... 427/77, 427/78

See application file for complete search history.

(56) References Cited

U.S. PATENT DOCUMENTS

| | | | | |
|---|---|---|---|---|
| 3,611,077 | A | 10/1971 | Smith | 315/94 |
| 4,566,186 | A | 1/1986 | Bauer et al. | 29/852 |
| 4,600,137 | A | 7/1986 | Comerford | 228/102 |

(Continued)

FOREIGN PATENT DOCUMENTS

| | | |
|---|---|---|
| CN | 1131305 | 9/1996 |

(Continued)

OTHER PUBLICATIONS

Random House College Dictionary, Revised Edition, copyright 1982, p. 1319*

(Continued)

*Primary Examiner*—Brian K Talbot
(74) *Attorney, Agent, or Firm*—Fitzpatrick, Cella, Harper & Scinto

(57) ABSTRACT

A novel process for producing an electron source substrate is disclosed for formation of electron-emitting element at high efficiency with less shape irregularity. In the process, the region for electroconductive film formation is divided into plural subregions on which an electroconductive film is formed respectively. In forming the electroconductive film by application of plural liquids, the time interval between the application of the two drops is controlled to be larger than the time length necessary for suppressing the spreading of the succeedingly applied liquid within an allowable limit.

22 Claims, 17 Drawing Sheets

U.S. PATENT DOCUMENTS

| | | | | |
|---|---|---|---|---|
| 4,668,533 | A | 5/1987 | Miller | 427/98 |
| 4,891,242 | A | 1/1990 | Ito et al. | 427/53.1 |
| 5,023,110 | A | 6/1991 | Nomura et al. | 427/49 |
| 5,114,744 | A | 5/1992 | Cloutier et al. | 427/96 |
| 5,275,646 | A | 1/1994 | Marshall et al. | 106/20 B |
| 5,320,703 | A | 6/1994 | Ikeda et al. | 117/68 |
| 5,338,688 | A | 8/1994 | Deeg et al. | 436/180 |
| 5,401,535 | A | 3/1995 | Bishop | 427/229 |
| 5,407,473 | A | 4/1995 | Miura et al. | 106/20 B |
| 5,498,444 | A | 3/1996 | Hayes | 427/162 |
| 5,505,777 | A | 4/1996 | Ciardella et al. | 118/663 |
| 5,530,314 | A | 6/1996 | Banno et al. | 313/310 |
| 5,593,499 | A | 1/1997 | Stans et al. | 118/63 |
| 5,594,296 | A | 1/1997 | Mitsutake et al. | 313/309 |
| 5,650,199 | A | 7/1997 | Chang et al. | 427/333 |
| 5,743,946 | A | 4/1998 | Aoki et al. | 106/31.95 |
| 5,814,434 | A | 9/1998 | Nakamura et al. | 430/25 |
| 5,832,595 | A | 11/1998 | Maruyama et al. | 29/829 |
| 5,861,227 | A | 1/1999 | Ikeda et al. | 430/31 |
| 6,005,333 | A | 12/1999 | Kaneko et al. | 313/306 |
| 6,017,259 | A * | 1/2000 | Motoi et al. | 445/51 |
| 6,060,113 | A | 5/2000 | Banno et al. | 427/78 |
| 6,169,356 | B1 | 1/2001 | Ohnishi et al. | 313/495 |
| 6,210,245 | B1 | 4/2001 | Sando et al. | 445/6 |
| 6,220,912 | B1 | 4/2001 | Shigeoka et al. | 445/24 |
| 6,221,426 | B1 | 4/2001 | Yamanobe | 427/77 |
| 6,296,896 | B1 * | 10/2001 | Takahashi et al. | 427/77 |
| 6,390,873 | B1 | 5/2002 | Banno et al. | 445/6 |
| 6,419,746 | B1 | 7/2002 | Banno et al. | 118/323 |
| 6,511,545 | B2 | 1/2003 | Banno et al. | 118/688 |
| 6,514,559 | B1 * | 2/2003 | Miyamoto et al. | 427/78 |
| 6,514,599 | B1 | 2/2003 | Ali et al. | 427/78 |
| 6,613,399 | B2 | 9/2003 | Miyamoto et al. | 427/588 |
| 6,786,589 | B2 * | 9/2004 | Suzuki et al. | 347/102 |

FOREIGN PATENT DOCUMENTS

| | | | |
|---|---|---|---|
| EP | 0620581 | A | 10/1994 |
| EP | 0658916 | A2 | 6/1995 |
| EP | 0717428 | A2 | 6/1996 |
| EP | 0 736 890 | | 10/1996 |
| EP | 0 736 892 | A1 | 10/1996 |
| EP | 0736890 | A1 | 10/1996 |
| EP | 0769796 | A1 | 4/1997 |
| JP | 62-181490 | | 8/1987 |
| JP | 63-155527 | | 6/1988 |
| JP | 63-200041 | | 8/1988 |
| JP | 64-5095 | | 1/1989 |
| JP | 64-64290 | | 3/1989 |
| JP | 1-296532 | | 11/1989 |
| JP | 0256822 | | 2/1990 |
| JP | 2-247939 | | 10/1990 |
| JP | 4-121702 | | 4/1992 |
| JP | 8171850 | A | 7/1996 |
| JP | 8-271724 | | 10/1996 |

OTHER PUBLICATIONS

Mead, C.A., "Operation of Tunnel-Emission Devices," Journal of Applied Physics, 1961, vol. 32, pp. 646-652.

Elinson, M.I., "The Emission of Hot Electronics and the Field Emission of Electrons from Tin Oxide," Radio Engineering and Electron Physics, 1965, pp. 1290-1296.

Dittmer, G., "Electrical Conduction and Electron Emission of Discontinuous Thin Films," Thin Solid Films, 1972, vol. 9, pp. 317-328.

Spindt, C.A., "Physical Properties of Thin-Film Field Emission Cathodes with Molybdenum Cones," Journal of Applied Science, 1976, vol. 47, pp. 5248-5263.

W.P. Dyke, et al., "Field Emission", Advances in Electronics and Electron Physics, vol. viii, 1956.

M. Hartwell, et al., "Strong Electron Emission From Patterned Tin-Indium Oxide Thin Films", International Electron Devices Meeting, pp. 519-521, 1975.

H. Araki, "Electroforming and Electron Emission of Carbon Thin Films", Journal of the Vacuum Society of Japan, vol. 26, No. 1, pp. 22-29, 1981.

Patent Abstracts of Japan, vol. 014, No. 573 (E-1015), Dec. 19, 1990 & JP 02 247939 A (Canon Inc.) Oct. 3, 1990.

H. Araki et al., "Electroforming and Electron Emission of Carbon Thin Films", J. Vac. Soc. Jpn., 26, 1, 22-29 (1981).

M. Hartwell et al., "Strong Electron Emission From Patterned Tin-Indium Oxide Thin Films", Int'l Electron Devices Mtg., Washington, D.C., 519-521 (1975).

G. Dittmer, "Electrical Conduction and Electron Emission of Discontinuous Thin Films", Thin Solid Films, 9, 317-328 (1972).

* cited by examiner

METHOD FOR PRODUCTION OF ELECTRON SOURCE SUBSTRATE PROVIDED WITH ELECTRON EMITTING ELEMENT AND METHOD FOR PRODUCTION OF ELECTRONIC DEVICE USING THE SUBSTRATE

This application is a continuation of application Ser. No. 10/265,264, filed Oct. 7, 2002, now abandoned, which is a division of application Ser. No. 09/044,016, filed Mar. 19, 1998, now U.S. Pat. No. 6,514,559, issued Feb. 4, 2003.

BACKGROUND OF THE INVENTION

1. Field of the Invention

The invention covered by the present patent application relates to a method for the production of an electron source substrate provided with an electron emitting element and a method for the production of an electronic device using the substrate.

2. Related Background Art

The electron emitting element has been heretofore known in two broadly divided types, i.e. the thermoelectron emitting element and the cold cathode electron emitting element. The cold cathode electron emitting element comes in such types as the field emission type (hereinafter referred to as "FE type"), metal/insulating layer/metal type (hereinafter referred to as "MIM type"), and surface conduction type, for example.

As examples of the FE type electron emitting element, those elements which are disclosed in W. P. Dyke & W. W. Doran, "Field Emission," Advance in Electron Physics, 8, 89 (1956) or C. A. Spindt, "Physical Properties of Thin-film Field Emission Cathodes with Molybdenium Cones," J. Appl. Phys., 47, 5248 (1976) have been known.

As an example of the MIM type electron emitting element, the element which is disclosed in C. A. Mead, "Operation of Tunnel-Emission Devices," J. Appl. Phys., 32, 646 (1961) has been known.

As an example of the surface conduction type electron emitting element, the element which is disclosed in M. I. Elinson, Radio Eng. Electron Phys., 10, 1290 (1965) has been known.

The surface conduction type electron emitting element utilizes a phenomenon that flow of an electric current parallel to the surface of a thin film of small area formed on a substrate results in emission of electrons. The surface conduction type electron emitting elements include the element using a thin film of Au reported in G. Dittmer: Thin Solid Films, 9, 317 (1972), the element using a thin film of $In_2O_3/SnO_2$ reported in M. Hartwell and C. G. Fonstad: IEEE Trans. ED Conf., 519 (1975), and the element using a thin film of carbon reported in Hisashi Araki et al.: Vacuum, Vol. 26, No. 1, page 22 (1983) in addition to the element using a thin film of $SnO_2$ proposed by Elinson as mentioned above.

As a typical example of the surface conduction type electron emitting element, the construction of the element proposed by M. Hartwell et al. as mentioned above is illustrated in the form of a model in FIG. 20. In the figure, 1 denotes a substrate and 4 an electroconductive thin film which is formed of a metal oxide in the pattern shaped like the letter H by sputtering and so forth and made to incorporate therein an electron emitting portion 5 by a treatment of electrification called an energization forming which will be specifically described herein below. As illustrated in the figure, the interval L between element electrodes 2 and 3 is set at a length in the range of 0.5 to 1 mm and the width W' of the thin film at 0.1 mm. The electron emitting portion 5 is illustrated by way of model because the position and shape thereof are unclear or indefinite.

In the surface conduction type electron emitting element of this class, the practice of subjecting the electroconductive thin film 4 to the treatment of electrification called energization forming in advance of the emission of electrons thereby forming the electron emitting part 5 thereof has been in vogue. To be specific, the energization forming is aimed at causing an electron emitting portion to form by means of electrification. It consists, for example, in applying a DC voltage or very gradual elevation of voltage to the opposite terminals of the electroconductive thin film 4 mentioned above thereby forcing this thin film to sustain local fracture, deformation, or degeneration and, as a result, allowing formation of the electron emitting portion 5 in an electrically highly resistant state. The treatment, for example, locally inflicts a fisure to the electroconductive thin film 4 to enable this thin film to emit electrons from the neighborhood of the fisure. The surface conduction type electron emitting element which has undergone the energization forming treatment mentioned above is such that it is enabled to effect emission of electrons from the electron emitting part 6 in response to the application of voltage to the electroconductive thin film 4 and the consequent induction of flow of an electric current through the element.

The surface conduction type electron emitting element of the quality described above enjoys simplicity of construction and allows for the manufacture thereof by the use of the conventional technique of semiconductor production and, therefore, brings about the advantage of enabling a multiplicity of surface conduction type electron emitting elements to be formed as arrayed over a large surface area. Various applied studies in the application of this characteristic feature have been conducted. Charged beam sources and image forming devices such as display apparatuses may be cited as apt examples of the targets of the applied studies.

The construction of the electron emitting element disclosed by the present applicant for patent in JP-A-02-56822 is illustrated in FIG. 19. In this diagram, 1 denotes a substrate, 2 and 3 each an element electrode, 4 an electroconductive thin film, and 5 an electron emitting portion. Various methods are available for the production of the electron emitting element. For example, the electron electrodes 2 and 3 are formed on the substrate 1 by the vacuum thin-film technique popular in semiconductor processes and the photolithographic etching technique. Then, the electroconductive thin film 4 is formed by a dispersion coating method such as, for example, the spin coat. Thereafter, the electron emitting part 5 is formed by applying voltage to the element electrodes 2 and 3 thereby effecting a energization treatment. The conventional method of production cited above, when used to form a multiplicity of elements arrayed on a large surface area, has the disadvantage of rendering indispensable the provision of a photolithographic etching device of large scale, necessitating a large number of steps, and exalting the cost of production. As a means for overcoming these defects by patterning the electroconductive thin film of the surface conduction type electron emitting element without using the semiconductor process, a method for directly depositing a solution containing a metallic element in the form of liquids on a surface by the principle of ink jet has been proposed (as in JP-A-08-171850).

The conventional ink jet methods which are disclosed in JP-A-08-171850 and so forth, however, effect the direct deposition of liquids by the use of such a single head as is illustrated in FIGS. 18A, 18B, and 18C (the component parts illustrated therein have the same meanings as those of FIG. 19). As the substrate gets larger in surface area, a lot of time is required for patterning one substrate, and there is a limit on the increase in the throughput. The conventional methods also have the disadvantage of boosting the cost of equipment because it requires the stroke of the relative motion between the substrate and the head to be increased in accordance with the size of the substrate.

The task assigned to the present invention consists in decreasing the time required for the production of the electron source substrate, increasing the yield of the production of electron source substrates, and improving the electron source substrate in quality.

SUMMARY OF THE INVENTION

One of the objects of the present invention is to shorten the time for production of an electron source substrate. For this object, the present invention is constituted as below.

The process of the present invention produces an electron source substrate having plural electron-emitting elements having respectively a pair of element electrodes counterposed with a spacing, an electroconductive film placed in the spacing and connected to both of the pair of element electrodes, and an electron-emitting portion formed in the electroconductive film. The process comprises a step of forming the electroconductive films by application of a metal element-containing solution in a state of a liquid onto regions of the electroconductive film formation on the substrate, wherein at least one liquid outlet is counterposed to each of the regions having respectively plural sites for electroconductive film formation, and the liquid outlets and the substrate are moved relatively to apply the liquid at least once onto the respective sites for electroconductive film formation.

The time for the production can be reduced, and the relative movement range can be reduced by application of the liquid from the outlets to the respective regions.

The range of the relative movement of the liquid outlets and the substrate can be decreased by fixing the relative positions of the plural liquid outlets. The relative positions of the plural outlets are preferably adjusted preliminarily.

In the present invention, the aforementioned plural regions are formed by dividing the area for the electroconductive film formation on the substrate in a first direction and a second direction not parallel to the first direction. The liquid can be applied. onto the respective regions by discharge of the liquid from the liquid outlet, with movement (scanning) of the liquid outlets in the first direction, onto the respective sites of the electroconductive film formation, displacement of the liquid outlets in the second direction, and successive discharge of the liquid thereon with movement in the first direction.

The liquid application can be conducted efficiently by making the plural regions in a congruent shape in the present invention.

At least one head may be provided for each of the plural regions, and at least one liquid may be provided in each head in the present invention.

In the case where the liquid is applied in plural times in one electroconductive formation site, the process of the present invention is constituted as below for preventing deformation of the electroconductive film or for improving the uniformity of the electroconductive film.

The process of the present invention produces an electron source substrate having an electron-emitting element comprising a pair of element electrodes counterposed with a spacing, an electroconductive film placed in the spacing and connected to both of the pair of element electrodes, and an electron-emitting portion formed in the electroconductive film. The process comprises a step of forming the electroconductive film by application of a metal element-containing solution in a state of a liquid from the liquid outlet two or more times onto the portion of the electroconductive film region on the substrate, wherein the time interval between one liquid application and the succeeding liquid application is larger than the time length for controlling the spreading of the succeedingly applied liquid within an allowable limit.

In this configuration of the invention, in applying a liquid onto plural electroconductive film formation sites, the number of the electroconductive film formation sites, the temperature or humidity in the liquid application, the solution composition of the applied liquid, the solvent composition of the solution, and so forth are suitably selected to satisfy the above conditions in the second or later application of the liquid and to shorten the waiting time.

In the case, in the present invention, where at least one liquid outlet is counterposed to respective plural regions having respectively plural sites for electroconductive film formation, and the liquid outlet and the substrate are moved relatively to apply the liquid at least once onto the respective sites for electroconductive film formation, the conditions of the temperature or humidity in the liquid application, the solution composition of the applied liquid, the solvent composition of the solution, and the number of the divided subregions of the electroconductive film area are suitably selected to satisfy the above conditions of the time interval of the application of the liquid and to shorten the waiting time.

The aforementioned time interval for suppressing the spreading of the succeedingly applied liquid within an allowable limit herein may be a time interval to retain the spreading of the succeedingly or later applied liquid within the approximate range of spreading of the firstly applied liquid, or may be a time interval for suppressing the spreading of the liquids in each liquid application to attain finally acceptable spreading range for preparation of a desired electron-emitting element when the liquid is applied two or more times. More specifically, the time. interval may be longer than 1.8 seconds.

In the present invention, the liquid application may be conducted by an ink-jet system. Specifically, the ink-jet system may be the one employing thermal energy to generate bubbles in a solution to eject the solution by the bubbles, or may be the one employing a piezo-element to eject the solution.

The process of the present invention for producing an electronic apparatus having an electron source substrate having plural electron-emitting elements comprises a pair of element electrodes counterposed with a spacing, an electroconductive film placed in the spacing and connected to both of the pair of element electrodes, and an electron-emitting portion formed in the electroconductive film; and an irradiation-receiving member to be irradiated by electrons emitted from the electron-emitting element: the process comprising producing the electron source substrate produced by any of the above methods for producing the electron source substrate.

The irradiation-receiving member may be an image-forming member which forms an image by irradiation of electrons, a light emitter or a phosphor which emits light by irradiation of electrons.

DESCRIPTION OF THE PREFERRED EMBODIMENTS

Preferred embodiments of the present invention are described below.

Figure 8A:
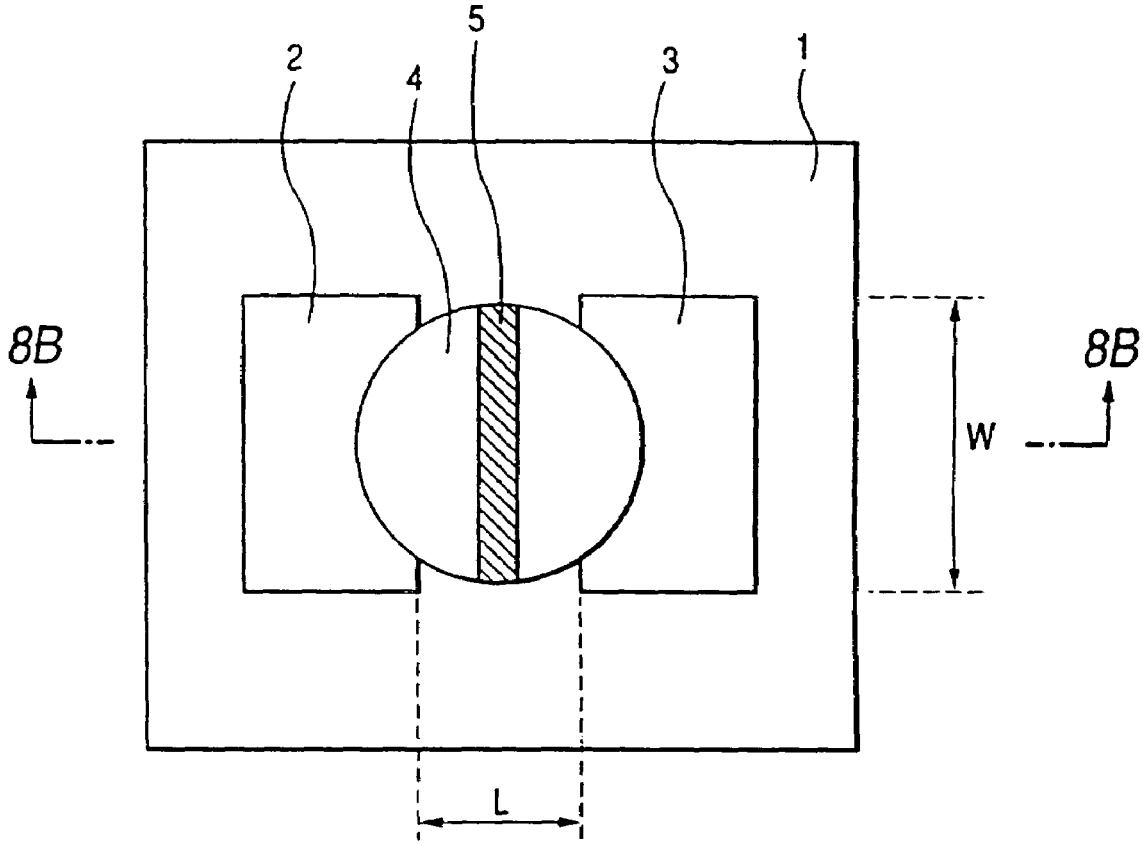
FIG. 8A and FIG. 8B are a schematic plan view and a schematic sectional view illustrating the constitution of a surface conduction type electron-emitting element to which the present application is applied.
Figure 8B:
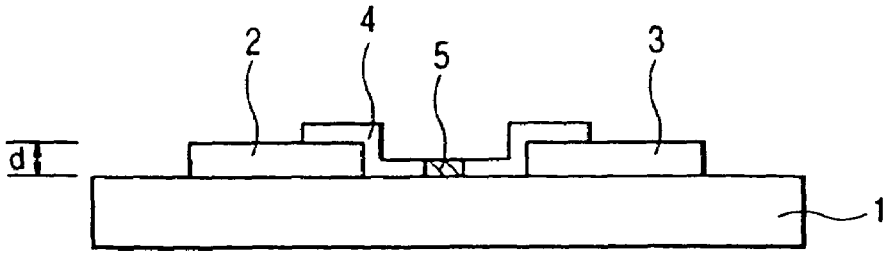

Firstly, a surface conduction type electron-emitting element is explained to which the present invention is applicable. FIG. 8A and FIG. 8B are a schematic plan view and a schematic sectional view illustrating configuration of a surface-conduction type electron-emitting element to which the present application is applicable. In FIG. 8A and FIG. 8B, the element comprises substrate 1, element electrodes 2, 3, electroconductive thin film 4, and electron-emitting portion 5.

Substrate 1 may be made of quartz glass, low-impurity glass containing less content of impurity like Na, soda lime glass, a glass base plate having $SiO_2$ deposited on the surface, a ceramic base plate such as an alumina plate, or the like.

The materials for counter electrodes 2,3, which are opposite to each other, may be selected suitably from various electroconductive materials including metals such as Ni, Cr, Au, Mo, W, Pt, Ti, Al, Cu, and Pd, and alloys thereof; printed conductors constituted of a metal or a metal oxide such as Pd, As, Ag, Au, $RuO_2$, and Pd—Ag, and glass or the like; transparent conductors such as $In_2O_3$—$SnO_2$; and semiconductor materials such as polysilicon.

Spacing L between the element electrodes, length W of the element electrodes, the shape of electroconductive thin film 4, and so forth are designed to meet the practical use. Element electrode spacing L ranges preferably from several thousand Å to several hundred μm, more preferably from 1 μm to 100 μm in consideration of the voltage applied between the element electrodes.

Length W of the element electrodes ranges from several μm to several hundred μm in consideration of the resistivity of the electrodes and electron-emitting characteristics. Thickness d of element electrodes 2,3 ranges from 100 Å to 1 μm.

Another configuration different from that shown in FIG. 8 may be employed in which electroconductive thin film 4 and counter element electrodes 2,3 are laminated in this order on substrate 1.

Electroconductive thin film 4 is preferably made from a fine particle film constituted of fine particles for achieving desired electron-emitting characteristics. The thickness of the film is designed in consideration of step coverage of element electrodes 2,3, the resistivity between element electrodes 2,3, the energization forming conditions mentioned later, and so forth. The thickness range is preferably several Å to several thousand Å, more preferably from 10 Å to 500 Å. The resistance range is from $10^2$ to $10^7$ Ω/square in terms of $R_s$. Here the value $R_s$ is a function of R: $R=R_s(1/w)$, where R is the resistance of a thin film of thickness t, width w, and length l, and $R_s=\rho/t$ at a resistivity ρ of the thin film material. Herein, the forming treatment is described regarding energization treatment as an example, but is not limited thereto. Any forming method is applicable which gives a high resistance state by fissure formation in the film.

Electroconductive film 4 may be constituted of a material including metals such as Pd, Pt, Ru, Ag, Au, Ti, In, Cu, Cr, Fe, Zn, Sn, Ta, W, and Pb; metal oxides such as PdO, $SnO_2$, $In_2O_3$, PbO, and $Sb_2O_3$; borides such as $HfB_2$, $ZrB_2$, $LaB_6$, $CeB_6$, $YB_4$, and $GdB_4$; carbides such as TiC, ZrC, HfC, TaC, SiC, and WC; nitrides such as TiN, ZrN, and HfN; semiconductors such as Si, and Ge; carbon; and the like.

The fine particle film herein is a film constituted of assemblage of fine particles, the fine structure including a state of dispersion of individual fine particles, and a state of fine particles in adjacent to each other or piled up (including island-like structure containing aggregation of fine particles). The diameter of the fine particle ranges preferably from several Å to 1 μm, preferably from 10 Å to 200 Å.

A method is described below for forming an electroconductive thin film of a surface conduction type electron-emitting element according to the present invention.

Figure 1:
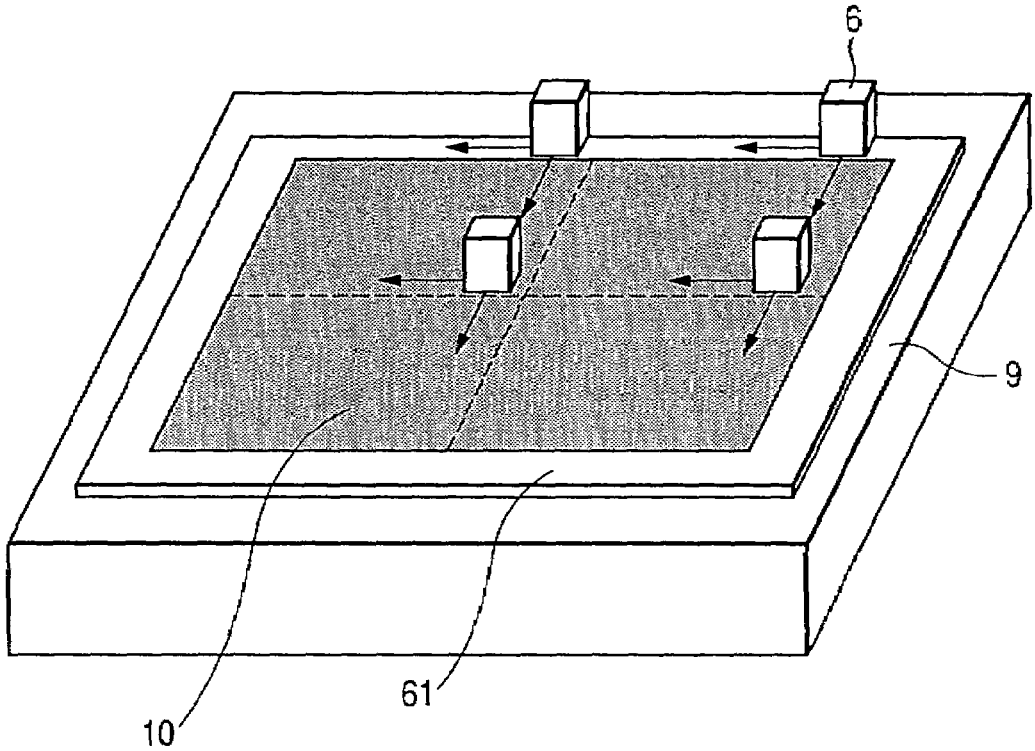
FIG. 1 is a schematic perspective view illustrating a method of application of liquids in an example of the present invention.
Figure 2:
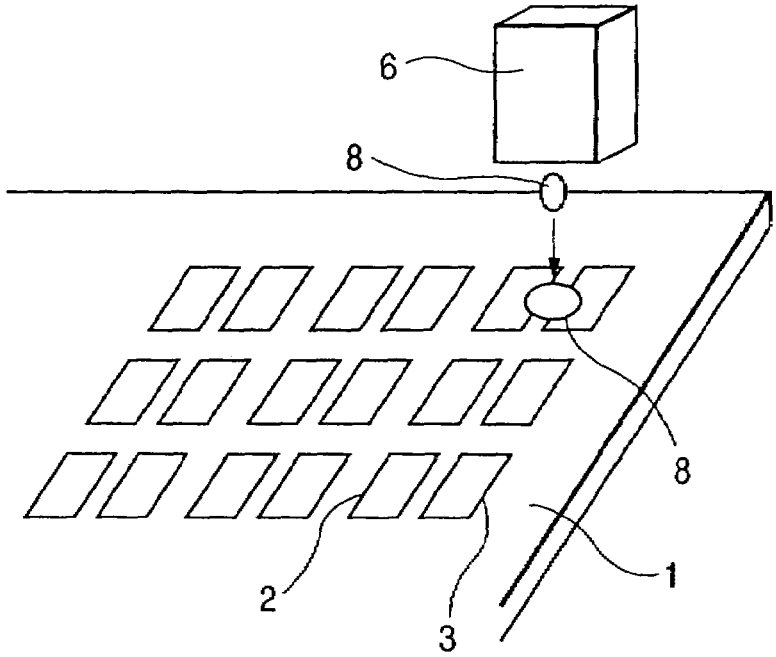
FIG. 2 is an enlarged view of a part of a head and a part of an element portion.

FIG. 1 illustrates schematically a process for producing an electron source substrate by use of plural ink-jet heads according to the present invention. In FIG. 1, the numeral 6 indicates an ink-jet head, 9 a stage, 10 an electron-emitting region, and 61 an electron source substrate. FIG. 2 is an enlarged view around the head at the upper-right side in FIG. 1, and illustrates roughly relative positions of ink-jet head 6, element electrodes 2,3, and liquid 8. The numeral 1 indicates a substrate. In the drawings, to each of equal divisions (subregions) of the element region, one ink-jet head is employed, in one-to-one correspondence, to apply a liquid containing an electroconductive thin film material.

The mechanism of the liquid discharging head is not limited, provided that it is capable of discharging desired liquids in a desired amount (constant or variable). In particular, a mechanism of an ink-jet system is suitable which is capable of forming liquids of about several ten nanograms. The ink-jet system may be of any type such as piezo-jet systems employing a piezo-element, and bubble jet systems employing thermal energy of a heater to form bubbles for ejection.

Figure 9:
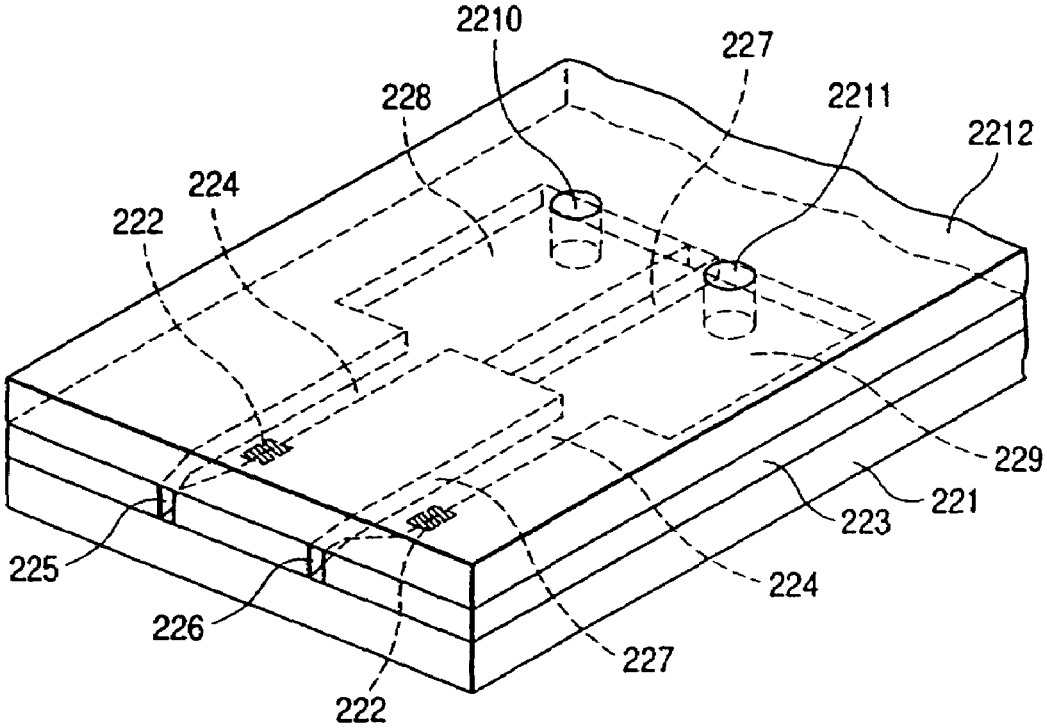
FIG. 9 illustrates constitution of an example of an ink-jet head unit employed in the present invention.
Figure 10:
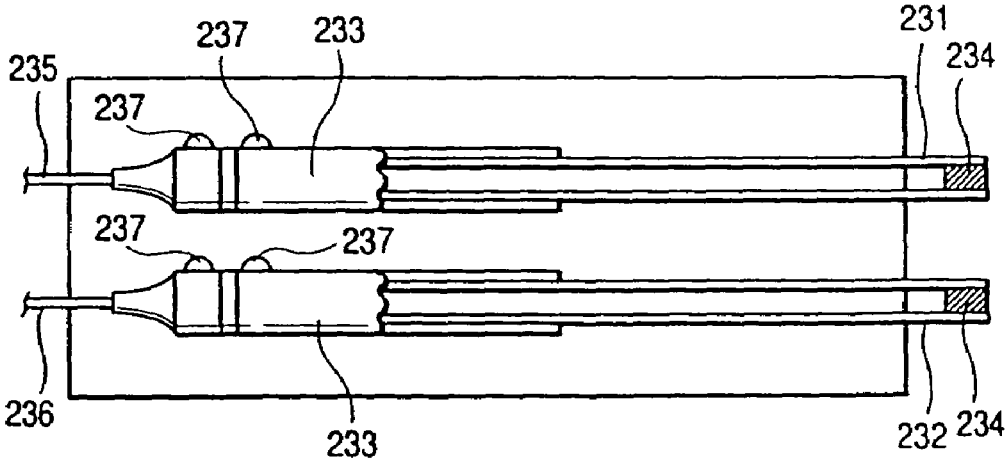
FIG. 10 illustrates another constitution of an example of an ink-jet head unit employed in the present invention.

FIG. 9 and FIG. 10 illustrates examples of the ink-jet head units. FIG. 9 illustrates a head unit of a bubble jet system having substrate 221, heat-generating portion 222, supporting plate 223, liquid flow path 224, first nozzle 225, second nozzle 226, partition wall 227 partitioning the ink flow paths, ink liquid rooms 228,229, ink feed inlets 2210,2211, and cover plate 2212.

FIG. 10 illustrates a head unit of a piezo-jet system having first nozzle 231 made of glass, second nozzle 232 made of glass, cylindrical piezo element 233, filter 234, liquid ink supply tubes 235,236, and electric signal input terminal 237. In FIGS. 9 and 10, two nozzles are employed, but the number of the nozzles is not limited thereto.

In FIGS. 1 and 2, liquid 8 may be composed of an aqueous solution or an organic solvent containing an element or a compound for forming the electroconductive thin film. For example, the liquid containing palladium or a compound thereof as the element or the compound for the electroconductive thin film formation includes aqueous solutions of an ethanolamine type complex such as palladium acetate-ethanolamine complex (PA-ME), palladium acetate-diethanolamine complex (PA-DE), palladium acetate-triethanolamine complex (PA-TE), palladium acetate-butylethanolamine complex (PA-BE), and palladium acetate-dimethylethanolamine complex (PA-DME); aqueous solutions of an amino acid type complex such as palladium-glycine complex (Pd-Gly), palladium-β-alanine complex (Pd-β-Ala), and palladium-DL-alanine complex (Pd-Dl-Ala); and-butyl acetate solution of palladium acetate-bis(dipropylamine) complex.

In application of the liquid, as shown in FIG. 1, the region of substrate 1 is equally divided into m×n subregions, m×n ink-jet heads (or integral multiple thereof) are employed corresponding to each of the equally divided subregion, and at least one liquid of the solution is applied onto each of the subregions of the element portion on the substrate with relative movement of the head and the substrate.

In this embodiment, the m×n ink-jet heads have liquid-drop application performance of m×n times that of a single head, so that the liquid application can be conducted in a time shorter by a factor of 1/(m×n) at the same relative movement speed of the substrate and the head, whereby the throughput can be improved.

Further, the relative movement region of the m×n ink-jet heads and the substrate are allowed to coincide with each other, and all of the heads are simultaneously moved in the same direction relative to the substrate. Thereby, the stroke of the driving mechanism for the relative movement can be reduced to 1/(m×n) times that of the treatment by a single head to make compact the driving mechanism and the entire apparatus in production of a large-area substrate.

In the case where the liquid application is conducted in plural times on one and the same element before drying of the previously applied liquid, a problem occurs because the additional liquid causes an increase in the dot diameter of the liquid which impairs the fineness of the formed pattern of the electroconductive thin film. Therefore, in liquid application in plural times, the m×n subregions are designed to take a time interval for drying depending on the temperature and humidity at the liquid application and the solvent composition of the liquid so that fine electroconductive thin film pattern can be formed stably and uniformly.

The organic metal solution drop thus applied onto the substrate is thermally decomposed by firing to form an electroconductive thin film.

Electron-emitting portion 5 in FIG. 8 is explained below. Electron-emitting portion 5 is constituted of fissures of high resistance formed in a part of electroconductive thin film 4, depending on the thickness, quality and material of electroconductive thin film 4 and energization forming. Electron-emitting portion 5 may contain electroconductive fine particles of diameter of 1000 Å or smaller in the interior. These electroconductive fine particles contain some or all of the elements constituting electroconductive thin film 4. Electron-emitting portion 5 and a portion of electroconductive thin film 4 neighboring thereto may contain carbon or a carbon compound.

Electroconductive thin film 4 thus formed is subjected to a forming treatment. For example, the forming treatment is conducted by an energization treatment such that electric current is allowed to flow between element electrodes 2,3 from a power source not shown in the drawing to modify the structure in the portion of electroconductive thin film 4 to form the electron-emitting portion.

The energization forming causes local structure change, such as destruction, deformation, and modification of electroconductive thin film 4. This changed site constitutes electron-emitting portion 5.

Figure 11A:
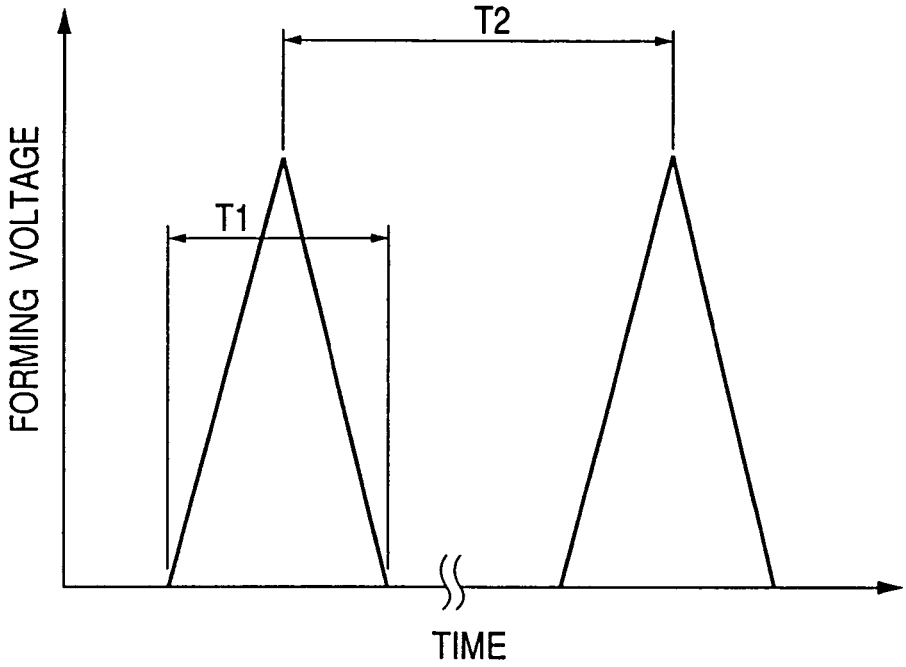
FIG. 11A and FIG. 11B shows an example of a voltage wave form applicable in a current forming treatment in the production of a surface-conduction type electron-emitting element of the present invention.
Figure 11B:
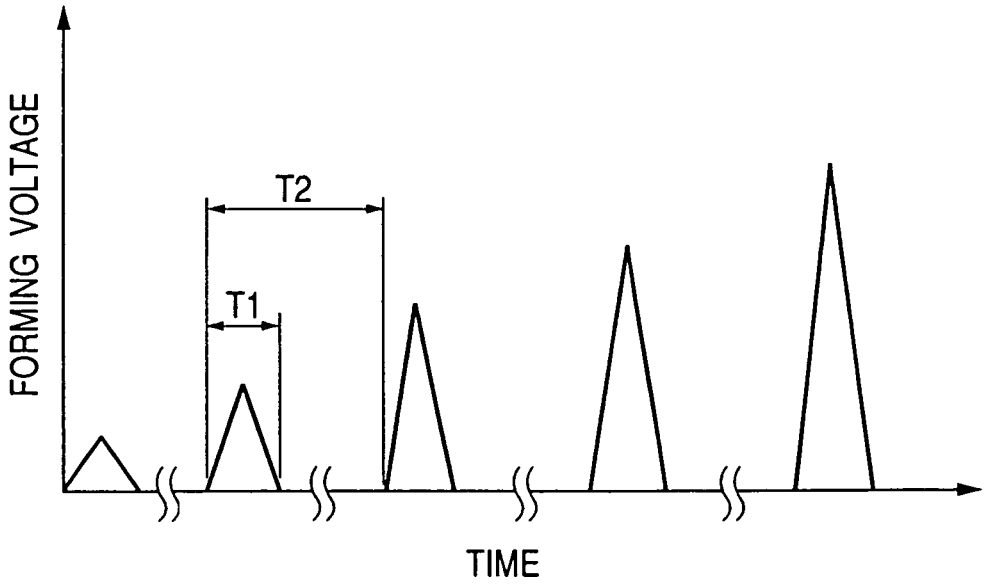

FIG. 11A and FIG. 11B show examples of the voltage wave form for the energization forming. The voltage wave is preferably in a pulse wave form, including a pulse of a constant height voltage continuously applied as shown in FIG. 11A and a pulse of increasing voltage as shown in FIG. 11B.

In FIG. 11A, T1 indicates a pulse width, and T2 indicates a pulse interval of the voltage wave form. Usually T1 is selected within the range from 1 μsec to 10 msec, and T2, from 10 μsec to 100 msec. The wave height of the triangle wave (peak voltage in energization forming) is selected suitably in correspondence with the shape of the surface conduction type electron-emitting element. Under such conditions, the voltage is applied for a time ranging from several seconds to several ten minutes. The pulse wave form is not limited to the triangle wave, but may be any desired wave form such as a rectangular wave.

In FIG. 11B, T1 and T2 may be similar to those in FIG. 11A. The wave height (peak voltage in energization forming) may be increased, for example, by about 0.1 volt per step.

The completion of the energization forming can be detected by applying a voltage not to break or not to deform locally the electroconductive thin film 4 in the pulse interval T2 and measuring the current intensity. For example, the energization forming is stopped when the resistance becomes 1 MΩ or more as measured by element current at application of voltage of about 0.1 V.

After the forming treatment, the element is preferably treated for activation. The activation treatment changes remarkably element current (If) and emitting current (Ie).

The activation treatment is conducted, for example, by repeated pulse application, as in the energization forming, in a gas atmosphere containing an organic substance. The organic substance-containing gas atmosphere can be formed, for example, by evacuating a vacuum chamber by an oil diffusion pump or a rotary pump and utilizing a remaining organic gas, or by evacuating sufficiently a vacuum chamber by an ion pump or the like and introducing a suitable organic substance gas into the vacuum. The pressure of the organic substance gas is decided depending on the type of practical use as mentioned before, the shape of the vacuum chamber, the kind of the organic substance, and so forth. Suitable organic substances include aliphatic hydrocarbons such as alkanes, alkenes, and alkynes; aromatic hydrocarbons; alcohols; aldehydes; ketones; amines; phenols; and organic acids such as carboxylic acid, and sulfonic acid. Specific examples thereof include saturated hydrocarbons represented by $C_nH_{2n+2}$ such as methane, ethane, and propane; unsaturated hydrocarbons represented by $C_nH_{2n}$ such as ethylene, and propylene; benzene; toluene; methanol; ethanol; formaldehyde; acetaldehyde; acetone; methyl ethyl ketone; methylamine; ethylamine; phenol; formic acid; acetic acid; propionic acid; and the like. By this treatment, carbon or a carbon compound deposits from the organic substance in the atmosphere onto the element to change remarkably element current If and emission current Ie. The pulse width, the pulse interval, the pulse wave height, and so forth are suitably decided.

The completion of the activation treatment is detected by measurement of element current If and emission current Ie.

The aforementioned carbon or the organic compound includes graphite (monocrystalline or polycrystalline) and amorphous carbon (simple amorphous carbon, or a mixtureof amorphous carbon and fine crystals of the above graphite). The film thickness of the deposit is preferably not more than 500 Å, more preferably not more than 300 Å.

The electron-emitting element after the activation treatment is preferably further treated for stabilization. The stabilization treatment is conducted in a vacuum chamber having a partial pressure of organic substance of not higher than $1\times10^{-8}$ Torr, preferably not higher than $1\times10^{-10}$ Torr. The pressure in the vacuum chamber ranges preferably from $1\times10^{-6.5}$ to $10^{-7}$ Torr, more preferably not higher than $1\times10^{-8}$ Torr. The vacuum apparatus for evacuating the vacuum chamber is preferably oilless in order to avoid adverse effects of an oil on the characteristics of the element. Specifically the vacuum apparatus includes sorption pumps, and ion pumps. In evacuation, the Vacuum chamber is heated entirely to facilitate evacuation of adsorbed organic substance molecules on the vacuum chamber wall and the electron-emitting element. The evacuation under heating is preferably conducted at a temperature ranging from 80 to 200° C. for 5 hours or longer, but is not limited thereto. The evacuation conditions are selected suitably in consideration of the size of the vacuum chamber, the constitution of the electron-emitting element, and so forth. Incidentally, the partial pressure of the above organic substance is detected with a mass spectrometer by measuring the partial pressures of the organic molecules of mass number of 10-200 mainly composed of carbon and hydrogen and integrating the partial pressures.

After the stabilization treatment, in practical drive, the atmosphere of the stabilization treatment is preferably maintained, but is not limited thereto. By sufficient removal of the organic substance, the characteristics of the element can be maintained in a stable condition even if the vacuum degree decreases slightly. Such a vacuum atmosphere prevents additional deposition of carbon or a carbon compound, making stable element current If and emission current Ie.

The image-forming apparatus of the present invention is described below. In the image-forming apparatus, the electron-emitting element may be arranged in various manners on the electron source substrate.

In one arrangement, many electron-emitting elements arranged in parallel are connected at the respective ends. In such an arrangement, the electron-emitting elements are placed in parallel lines (in the row direction). Above this wiring, control electrodes(called also grids) are provided in a direction perpendicular to the above wiring (in the column direction) to form a ladder-like arrangement to control the electrons from the electron-emitting elements.

In another arrangement, electron-emitting elements are arranged in an X direction and Y direction in a matrix, and electrodes of one side of the respective electron-emitting elements are connected commonly in the X direction, and electrodes of another side are connected commonly in the Y direction. Such a type of arrangement is a simple matrix arrangement, and is described below in detail.

Figure 12:
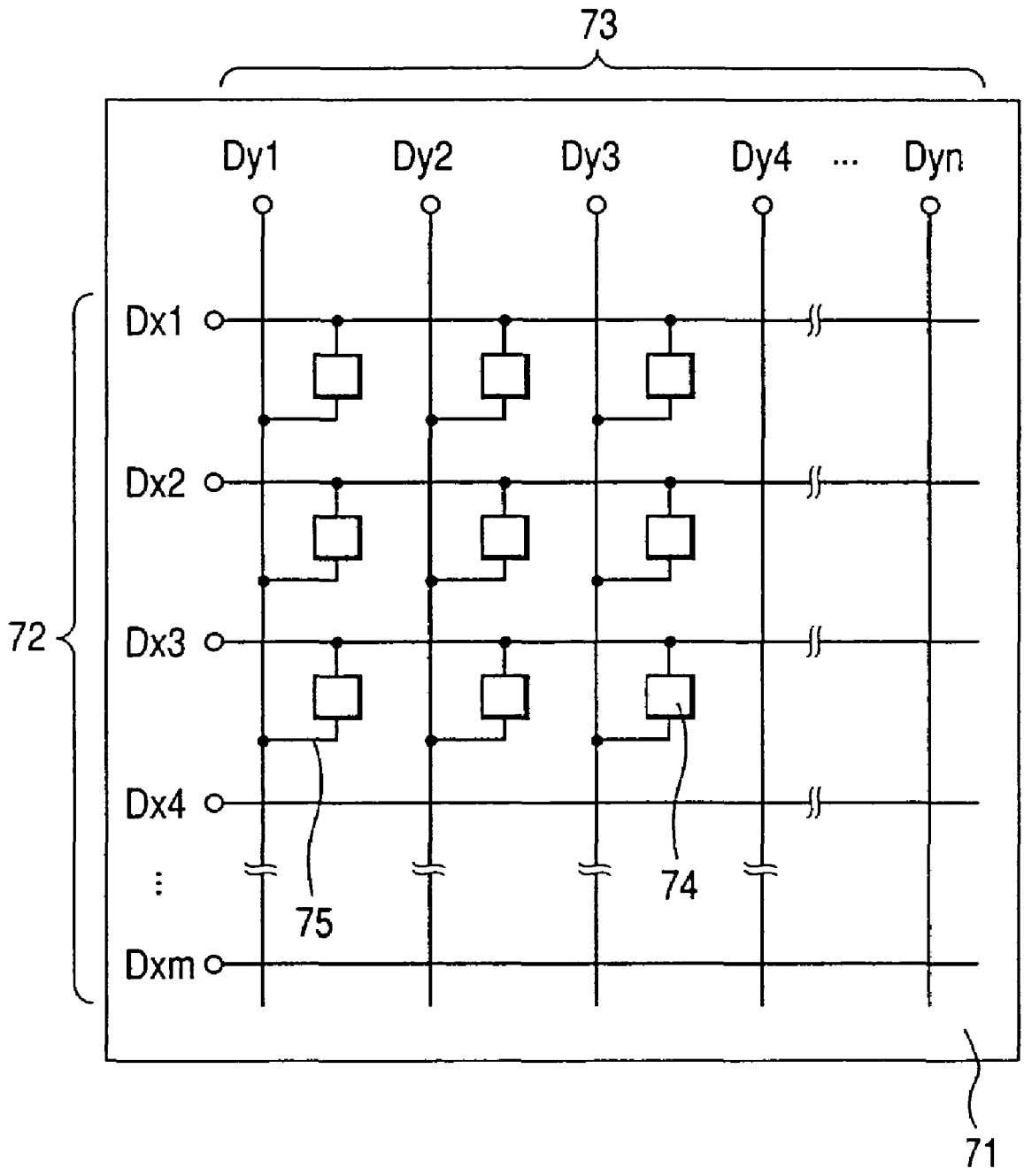
FIG. 12 is a schematic drawing illustrating a matrix arrangement type electron source substrate to which the present invention is applied.

The electron source substrate having electron-emitting elements arranged in a matrix of the present invention is explained by reference to FIG. 12. In FIG. 12, the numeral 71 indicates an electron source substrate, 72 an X-direction wiring, 73 a Y-direction wiring, 74 a surface conduction type electron-emitting element, and 75 a wiring.

X-Direction wiring 72 comprises m lines of wiring Dx1, Dx2, . . . , Dxm, which can be constituted of an electroconductive metal or the like. The material, the layer thickness, and the breadth of the wiring are suitably decided. Y-Direction wiring 73 comprises n lines of wiring Dy1, Dy2, . . . , Dyn, which is formed in the same manner as X-direction wiring 72. Between X-direction wiring 72 in m lines and Y-direction wiring 73 in n lines, is provided an insulating interlayer not shown in the drawing to isolate them both electrically. (The symbols m and n are respectively an integer.)

The insulating interlayer not shown in the drawing is constituted of $SiO_2$ or the like. For example, the insulating interlayer is provided on the entire or a part of the surface of substrate 71 having X-direction wiring 72. The thickness, the material, and the formation process of the insulating interlayer are selected to withstand the potential difference at the intersecting points of X-direction wiring 72 and Y-direction wiring 73. X-Direction wiring 72 and Y-direction wiring 73 are respectively led out as external terminals.

A pair of electrodes (not shown in the drawing) constituting electron-emitting element 74 are connected electrically by m lines of X-direction wiring 72, n lines of Y-direction wiring 73, and connecting lines. 75.

The chemical elements constituting the material for wiring 72 and wiring 73, the material for connecting lines 75, and the material for the element electrode pairs may be entirely the same, or may be different partly from each other. The materials may be selected, for example, suitably from the materials mentioned before for the element electrodes. When the material for the wiring is the same as the one of the element electrodes, the wiring connected to the element electrode may be called an element electrode.

To X-direction wiring 72, is connected a scanning signal applying means (not shown in the drawing) to apply scanning signals for selecting the line of the electron-emitting elements 74 in the X direction. To Y-direction wiring 73, is connected a modulation signal generating means (not shown in the drawing) to modulate the respective lines of electron-emitting elements 74 in the Y direction in accordance with input signals. The driving voltage for the respective electron-emitting elements is supplied as the voltage difference between the scanning signals and the modulation signals.

In the above configuration, an individual element can be selected and driven independently by use of the simple matrix wiring.

Figure 13:
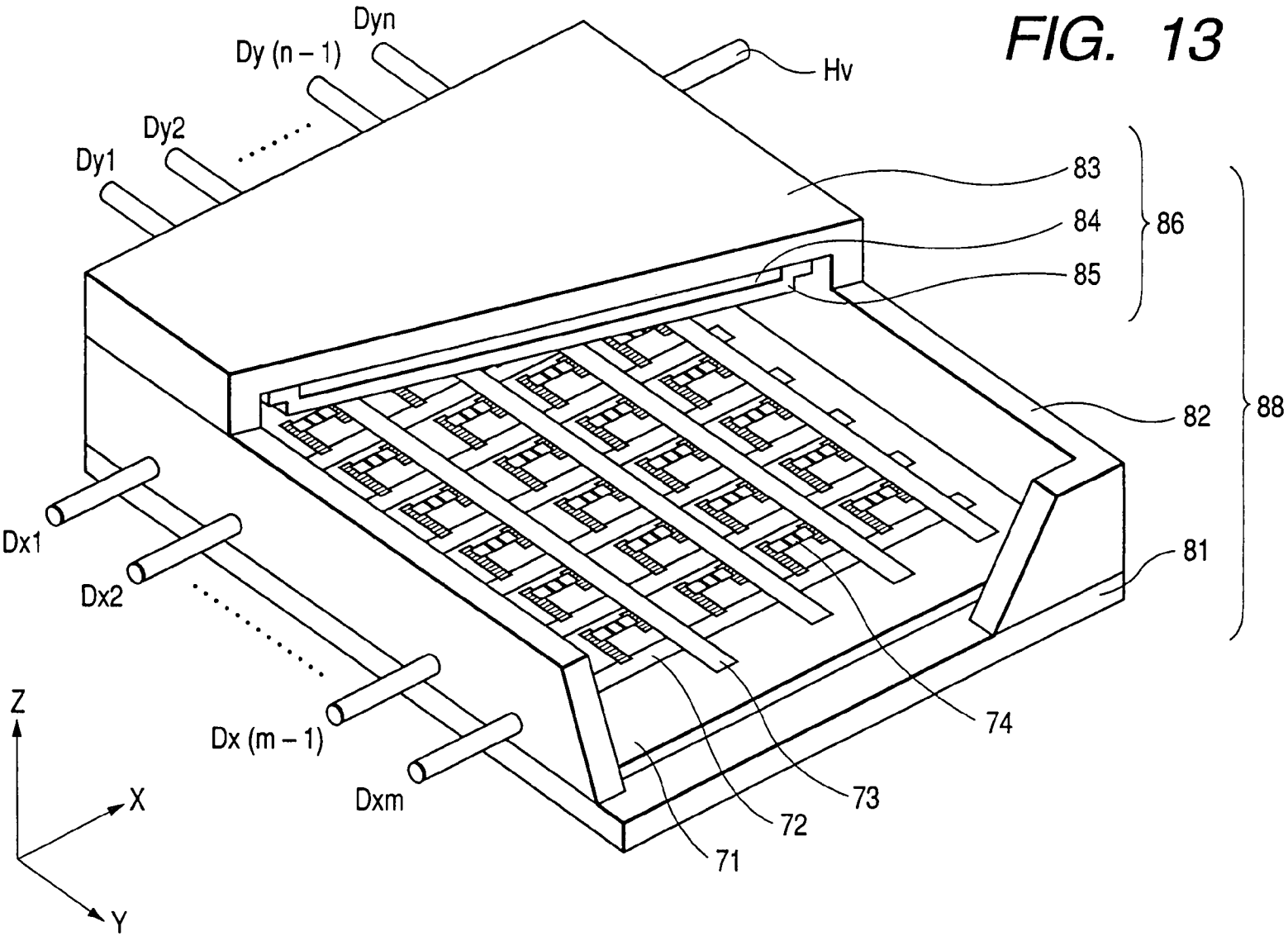
FIG. 13 is a schematic drawing illustrating a matrix wiring type display panel of an image-forming apparatus to which the present invention is applied.
Figure 14A:
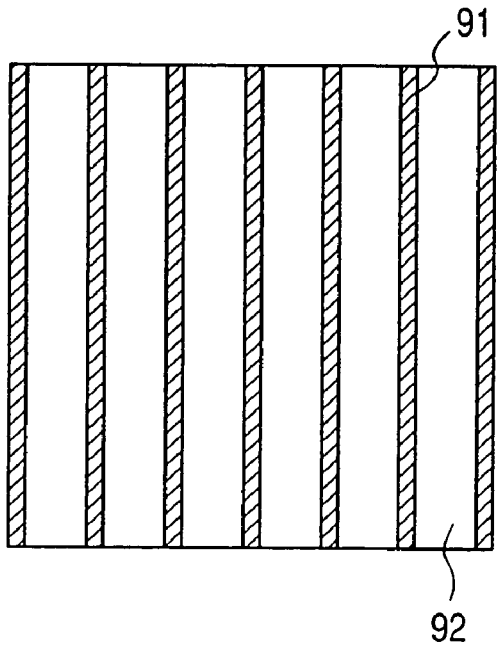
FIG. 14A and FIG. 14B. is a schematic drawing of an example of a phosphor film employed in an image-forming apparatus.
Figure 14B:
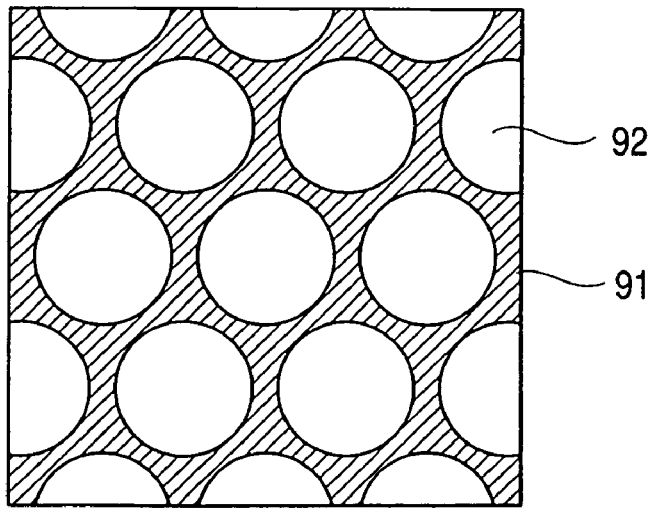
Figure 15:
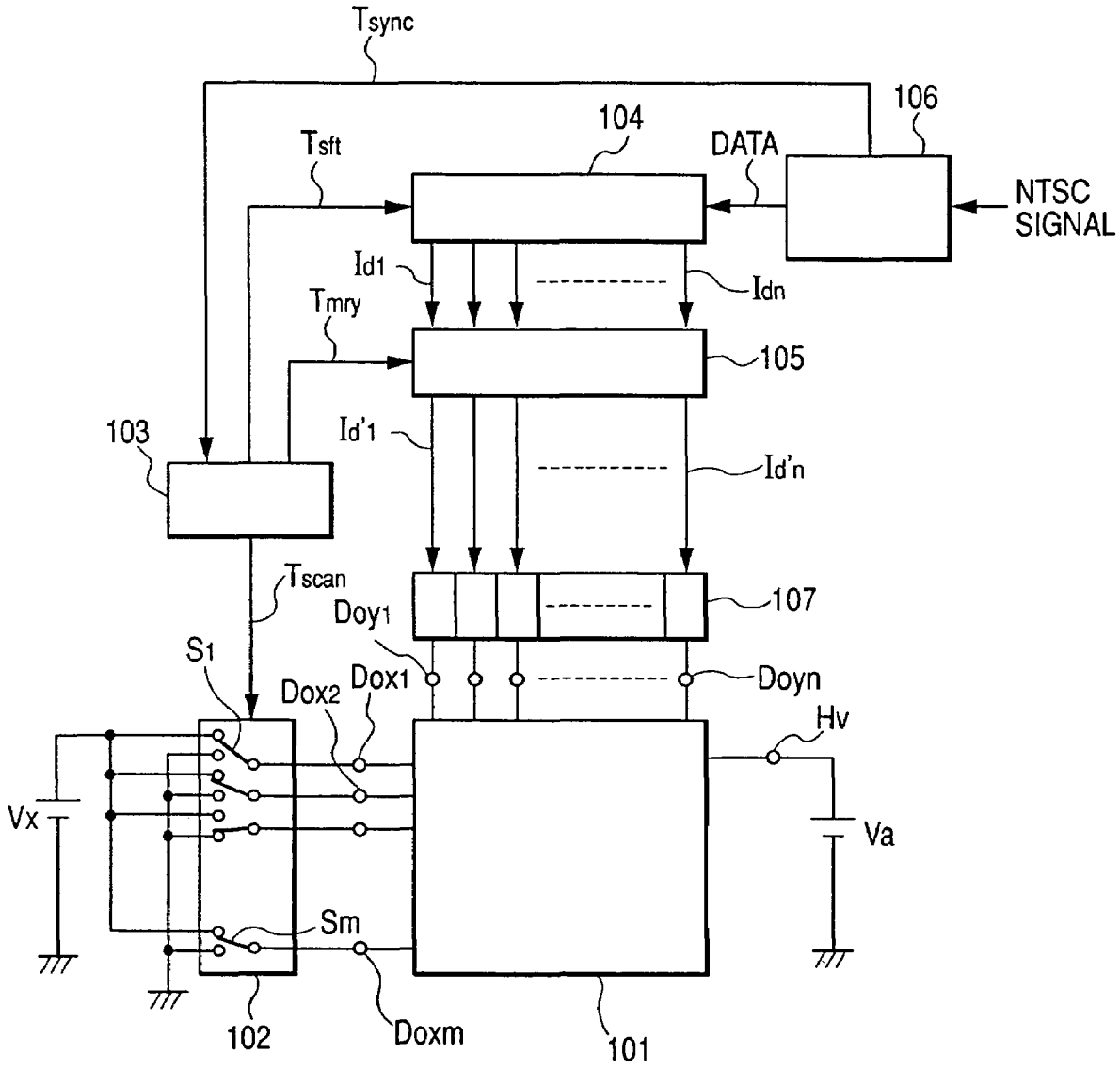
FIG. 15 is a block diagram of an example of a driving circuit for display for television signals of an NTSC system in an image-forming device prepared according to the process of the present invention.

An image-forming device constructed with an electron source substrate of a simple matrix arrangement is explained by reference to FIGS. 13 through 15. FIG. 13 illustrates schematically an example of the display panel of an image-forming apparatus. FIGS. 14A and 14B illustrate schematically a phosphor film employed in the display panel of FIG. 13. FIG. 15 is a block diagram of an example of a driving circuit for display in correspondence with NTSC type television signals.

In FIG. 13, electron-emitting elements are arranged on substrate 71. Rear plate 81 fixes substrate 71. Face plate 86 is constituted of glass substrate 83 having phosphor film 84, metal back 85, and so forth on the inside face. Rear plate 81 and face plate 86 are bonded to supporting frame 82 by frit glass or the like. Enclosure 88 is fusion-sealed by firing, for example, in the air or a nitrogen atmosphere at 400° C. to 500° C. for more than 10 minutes. The symbol Hv indicates a high voltage terminal.

Surface conduction type electron-emitting element 74 corresponds to the one element shown in FIGS. 8A and 8B. X-Direction wiring 72 and Y-direction wiring 73 are connected to the pairs of element electrodes of the surface conduction type electron-emitting elements 74.

Enclosure 88 is constituted of face plate 86, supporting frame 82, and rear plate 81 mentioned above. Since rear plate 81 is provided mainly for increasing the strength of substrate 71, separate rear plate 81 may be omitted if electron source substrate 71 itself has sufficient strength. That is, supporting frame 82 may be bonded directly to substrate 71, and face plate 86, supporting frame 82, and substrate 71 may constitute enclosure 88. On the other hand, between face plate 86 and rear plate 81, a supporting member called a spacer (atmospheric pressure resisting member) not shown in the drawing may be provided to give enclosure 88 a sufficient strength against the atmospheric pressure.

FIGS. 14A and 14B illustrate schematically a fluorescent film. A monochromatic fluorescent film may be constituted of a phosphor only. A color fluorescent film can be constituted of a black member 91 called black stripes (FIG. 14A) or a black matrix (FIG. 14B), and phosphors 92 depending on the arrangement of the phosphor. The black stripes or the black matrix is provided for the purpose of blackening the borders between the phosphors 92 of the three primary colors necessary for color display to make less remarkable the color mixing and to prevent drop of the contrast owing to external light reflection. The black stripes or the black matrix is usually made from a material showing less light transmittance or less reflection such as those mainly composed of graphite.

The phosphor can be applied onto glass substrate 83 by a precipitation method or a printing method either for monochrome or for multiple color. Usually metal back 85 is provided on the inside face of fluorescent film 84. The metal back is provided for the purpose of reflecting the light emitted inside by the phosphor toward the side of face plate 86 to improve the luminance, for serving as an electrode for applying an electron beam acceleration voltage, and for protecting the phosphor from damage caused by collision of negative ions generated within the enclosure. The metal back is prepared, after formation of the fluorescent film, by smoothing the inside surface of the fluorescent film (usually called "filming") and depositing Al thereon by vacuum deposition or a like method.

Further in face plate 86, a transparent electrode (not shown in the drawing) may be provided on the outside face of fluorescent film 84 (the side of glass substrate 83).

At the aforementioned fusion-sealing, for color display, the color phosphors should be positionally registered to be confronted respectively with an electron-emitting element.

The image-forming apparatus shown in FIG. 13 can be produced as below.

Enclosure 88 is evacuated with suitable heating in the same manner as in the aforementioned stabilization treatment through an evacuation opening by an oilless evacuation apparatus like an ion pump or a sorption pump to a vacuum degree of about $10^{-7}$ Torr to obtain an atmosphere containing little organic matter, and is sealed. For maintaining the vacuum in enclosure 88 after the sealing, getter treatment may be conducted. In the getter treatment, a getter (not shown in the drawing) placed at a prescribed position in enclosure 88 is heated immediately before or after the sealing of enclosure 88 by resistance heating, high-frequency heating, or a like heating method to form a vapor deposition film. Usually the getter is mainly composed of Ba or the like. The vapor-deposition film maintains the vacuum degree by sorption, for example, at $10^{-5}$ to $10^{-7}$ Torr in enclosure 88.

An example is explained of a configuration of the driving circuit for a television display based on a television signal of an NTSC system in a display panel employing an electron source substrate of a simple matrix arrangement by reference to FIG. 15. In FIG. 15, the numeral 101 indicates an image display panel, 102 a driving circuit, 103 a control circuit, 104 a shift register, 105 a line memory, 106 a synchronization signal separation circuit, and 107 a modulation signal generator, and the symbol Vx and Va indicate respectively a DC source.

Display panel 101 is connected to an external electric circuit through terminals Dox1, . . . , Doxm, terminals Doy1, . . . , Doyn, and high voltage terminal Hv. Scanning signals are applied to terminals Dox1, . . . , Doxm for driving the electron source, namely the surface conduction type electron-emitting source wired in a matrix of M rows and N columns, line-by-line (N elements in one line) sequentially. Modulation signals are applied to terminals Dy1, . . . , Dyn for controlling output electron beams of the respective elements of one line of the surface conduction type electron-emitting elements selected by the above scanning signals. A DC voltage, for example 10 kV, is applied from DC voltage source Va to high voltage terminal Hv. This voltage is an acceleration voltage for giving sufficient energy to the electron beam emitted by the electron-emitting element to excite the phosphor.

Scanning circuit 102 has M switching elements therein (indicated schematically by the symbols S1, . . . Sm). Each of the switching elements selects either the output voltage of DC voltage source Vx or 0 volt (ground level), and is connected electrically to any of terminals Dx1, . . . , Dxm of display panel 101. The switching elements S1, . . . , Sm function in accordance with control signals Tscan output from control circuit 103, and may be constituted of combination of switching elements like FET.

DC voltage source Vx in this example is set to output a constant voltage to maintain the elements not being scanned to be at a voltage lower than the electron-emitting threshold voltage according to the characteristics of the surface conduction type electron-emitting elements.

Control circuit 103 functions to match the operation of the respective sections to conduct suitable display according to the image signals applied from the outside. Control circuit 103 generates control signal of Tscan, Tsft, and Tmry in accordance with synchronization signal Tsync.

Synchronization signal separation circuit 106 separates the synchronization signal component and the luminance signal component in the television signals of an NTSC system inputted from the outside, and can be constituted of an ordinary frequency separation circuit (filter). The synchronization signals are separated by synchronization signal separation circuit 106 into vertical synchronization signals and horizontal synchronization signals. The synchronization signals are shown as Tsync signals in the drawing. The image luminance signal component separated from the above television signals are shown as DATA signals. The DATA signals are introduced to shift register 104.

Shift register 104 conducts serial/parallel conversion of the DATA signals inputted serially in time sequence for each one line of the image according to control signal Tsft introduced from control circuit 103. (Control signal Tsft may be considered to be a shift clock of shift register 104.) The data after the serial/parallel conversion for one line (corresponding to the driving data of N electron-emitting elements) are output as N parallel signals of Id1, . . . , Idn from shift register 104.

Line memory 105 is a memorizing device for memorizing image data for one line for a necessary time only, and memorizes content of Id1, . . . , Idn according to control signal Tmry sent from control circuit 103. The memorized content is output as I'd1, . . . , I'dn to be introduced to modulation signal generator 107.

Modulation signal generator 107 is a signal source for driving and modulating the respective electron-emitting elements appropriately in correspondence with image data, I'd1, . . . , I'dn. The output signals thereof are applied through terminals, Doy1, . . . , Doyn, to electron-emitting elements in display panel 101.

The surface conduction type electron-emitting element of the present invention has fundamental characteristics as below for discharge current Ie. There is a definite threshold voltage Vth in electron emission. The electron emission occurs only when a voltage higher than the Vth is applied to the element. Therefore, no electron emission occurs by application of a voltage lower than Vth, whereas an electron beam is emitted only by application of a voltage higher than Vth. With application of voltage higher than the electron emission threshold voltage, the emission current changes with the change of the voltage applied to the element. Therefore, in application of a pulse voltage to the element, electron emission does not occur at the voltage lower than the electron emission threshold voltage, whereas an electron beam is output at the voltage higher than the electron emission threshold voltage. The intensity of the electron beam output can be controlled by changing wave height Vm. The total amount of the electron charge of the electron beam output can be controlled by changing pulse width Pw.

Therefore, the electron emission element can be modulated in correspondence with the input signals by a voltage modulation method, a pulse width modulation method, or a like method. In the voltage modulation method, modulation signal generator 107 can employ a voltage modulation type circuit which generates a voltage pulse in a constant length and modulates the wave height of the pulse appropriately in accordance with the input data.

In the pulse width modulation method, modulation signal generator 107 can employ a pulse width modulation type circuit which generates a voltage pulse in a constant wave height and modulates the pulse width of the voltage pulse appropriately in accordance with the input data.

Shift resister 104 and line memory 105 may be either of a digital signal system or of an analog signal system, provided that serial/parallel conversion and memorization of the image signal can be conducted at a prescribed speed.

In the digital signal system, output signal DATA from synchronization signal separation circuit 106 should be converted into digital signals, which can be conducted by an A/D converter provided in the output portion of circuit 106. The circuit employed in modulation signal generator 107 differs slightly depending on the kind of the output signals, digital or analog, of line memory 105. In the voltage modulation system employing digital signals, modulation signal generator 107 may employ a D/A conversion circuit, and additionally an amplification circuit or the like as necessary. In pulse modulation system, modulation signal generator 107 may employ as the circuit a combination of a high-speed oscillator, a counter for counting the wave numbers of the output of the oscillator, and a comparator for comparing the output of the counter with the output of the above memory. If necessary, an amplifier may be added thereto for amplifying the voltage of the pulse-modified modification signals from the comparator to the driving voltage of the surface conduction type electron-emitting element.

In the voltage modulation system employing analog signals, the modulation signal generator 107 may employ an amplifier circuit containing an OP amplifier or the like. If necessary, a level shift circuit may be added thereto. In the pulse width modulation system, a voltage control type oscillation circuit (VCO) can be employed, and may contain, if necessary, an amplifier for amplifying the voltage to the driving voltage of the electron-emitting element.

In the display panel of the above configuration, electron emission is caused by application of a voltage through outside terminals Dox1, . . . , Doxm, and Doy1, . . . , to Doyn to the respective electron-emitting elements. High voltage is applied through high voltage terminal Hv to metal back 85 or a transparent electrode (not shown in the drawing) to accelerate the electron beam. The accelerated electrons collide against fluorescent film 84 to cause light emission for image formation.

The configuration of the image-forming apparatus described here is only an example, and can be modified in various manners based on the technical idea of the present invention. Signal is inputted by an NTSC system in the above explanation, but the signal input method is not limited thereto, and includes PAL systems, SECAM systems, and other TV signal systems (e.g., high-quality TV typified by an MUSE system) using more scanning lines.

A ladder arrangement type of electron source substrate and image-forming apparatus employing it is explained by reference to FIG. 16.

Figure 16:
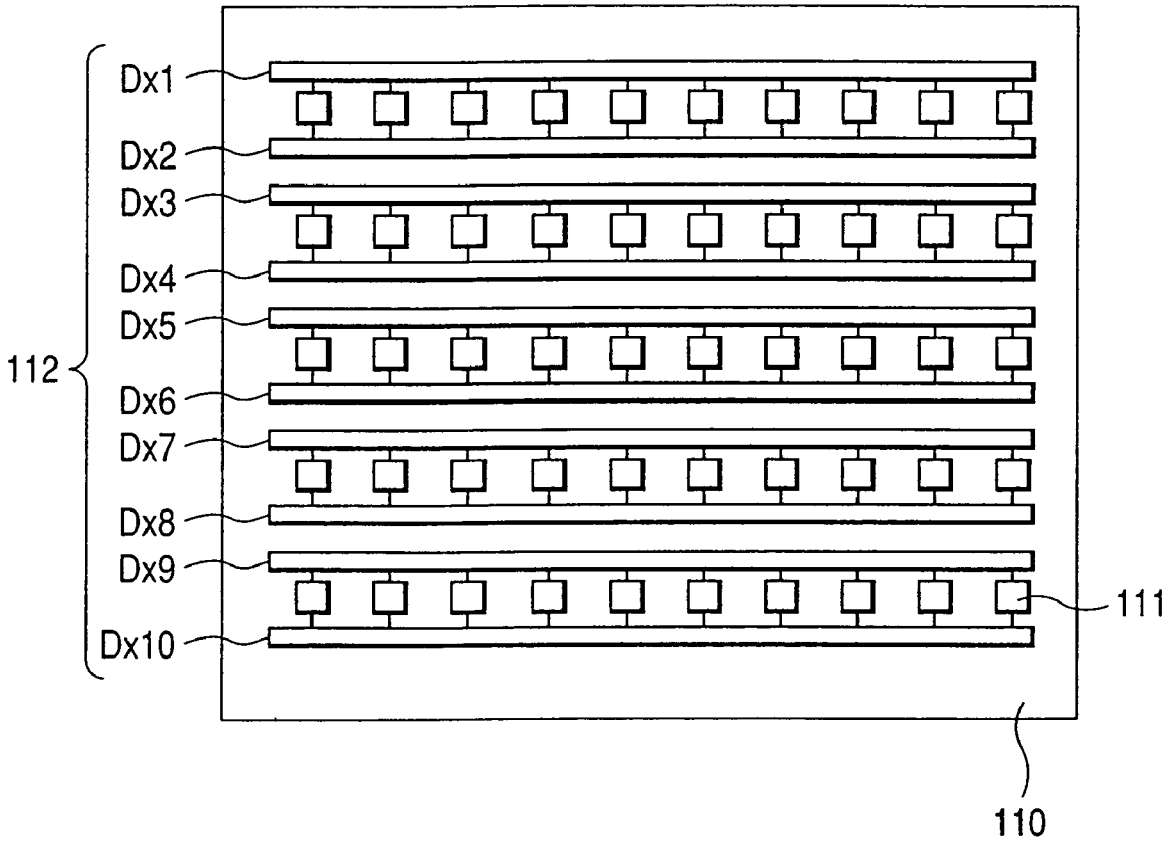
FIG. 16 is a schematic diagram illustrating an electron source substrate employing a ladder type wiring to which the present invention is applied.

FIG. 16 illustrates schematically an example of the ladder type electron source substrate. In FIG. 16, the numeral 110 indicates an electron source substrate, and the numeral 111 indicates an electron-emitting element. Common wiring 112 (Dx1, . . . , Dx10) connects electron-emitting elements 111. Plural electron-emitting elements 111 are arranged in parallel in the X direction (element line). The plural element lines constitute the electron source. Each of the element lines are driven independently by application of a driving voltage: application of a voltage higher than the electron emission threshold to the element line will cause electron beam emission, and a voltage lower than the electron emission threshold to the element will not cause the electron beam emission. Common wiring Dx2, . . . , Dx9 between the element lines, for example Dx2 and Dx3, may be of the same wiring.

The electron source substrate of FIG. 16, in place of the electron source of FIG. 12, may constitute an image-forming apparatus in a similar manner as in FIG. 13.

Now, this invention will be described more specifically below with reference to working examples.

EXAMPLE 1

FIG. 1 is a diagram which depicts the characteristic of this invention best, illustrating a method for producing an electron source substrate as an element using a plurality of ink jet heads. FIG. 2 represents part of FIG. 1 on a magnified scale, schematically illustrating the positional relation between the ink jet heads and the element electrode parts and the condition of deposition of liquids on a magnified scale. FIGS. 3A, 3B, 4A and 4B are schematic diagrams illustrating the relative motion between the ink jet heads and the substrate during the deposition of liquids.

The steps of the method for producing the electron source substrate will be described below sequentially in the order of their occurrence with reference mainly to FIGS. 1, 2, 3A, 3B, 4A and 4B.

In the present example, the substrate had a size about twice the conventional size and the number of equally divided m×n areas of the electron emitting element part was set at 4. As illustrated in FIG. 1, 9 denotes a stage supporting thereon an electron source substrate 61 which awaits the formation of an electroconductive thin film. Here, 10 denotes an electron emitting element area. This part is equally divided into 2×2, or four, areas. These equally divided areas each correspond to four ink jet heads.

It is FIG. 2 that depicts partly the head and the element part on a magnified scale. The surface conduction type electron emitting element on the electron source substrate has the same construction as that described above in the mode of embodiment. The component element is the same as that illustrated in FIG. 8 and is composed of a substrate 1, element electrodes 2 and 3, and an electroconductive thin film (fine particle film) 4. This electron source substrate 61 is further provided with a wiring electrode which is not shown in the diagram.

The procedure for the manufacture of this electron source substrate will be described briefly below.

Figure 6:
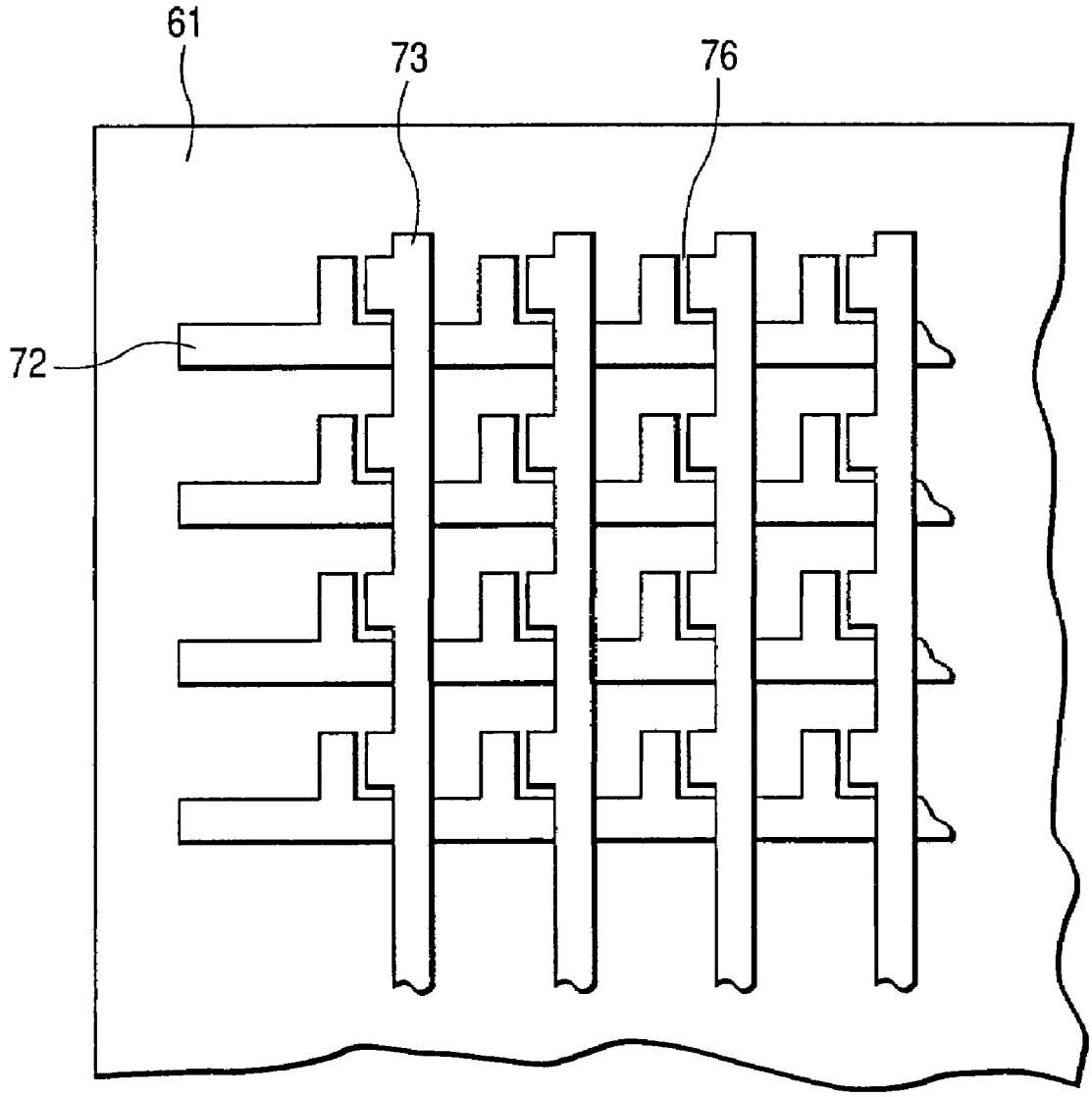
FIG. 6 illustrates schematically an electron source substrate of a matrix arrangement type prepared in Example 1 of the present invention.

First, a glass substrate was used as an insulating substrate. This glass substrate was thoroughly cleaned with an organic solvent, for example, and then dried in a drying oven at 120° C. On the substrate, a plurality of pairs of element electrodes each measuring 500 μm in width and separated by a gap of 20 μm were formed with a Pt film (2000 Å) and the electrodes were interconnected by wiring. A matrix wiring constructed as illustrated in FIG. 6 was adopted for this wiring.

The solution used as the raw material for the liquids was an aqueous solution which was obtained by dissolving in water polyvinyl alcohol in a weight concentration of 0.05%, 2-propanol in a weight concentration of 15%, ethylene glycol in a weight concentration of 1%, and a palladium acetate-ethanol amine complex $[Pd(NH_2CH_2CH_2OH)_4(CH_3COO)_2]$ in a palladium weight concentration of 0.15%. For the ink jet heads, the principle of bubble jet which consisted in producing bubbles in the solution by means of thermal energy and inducing emission of the solution by virtue of the formation of bubbles was utilized.

Figure 3A:
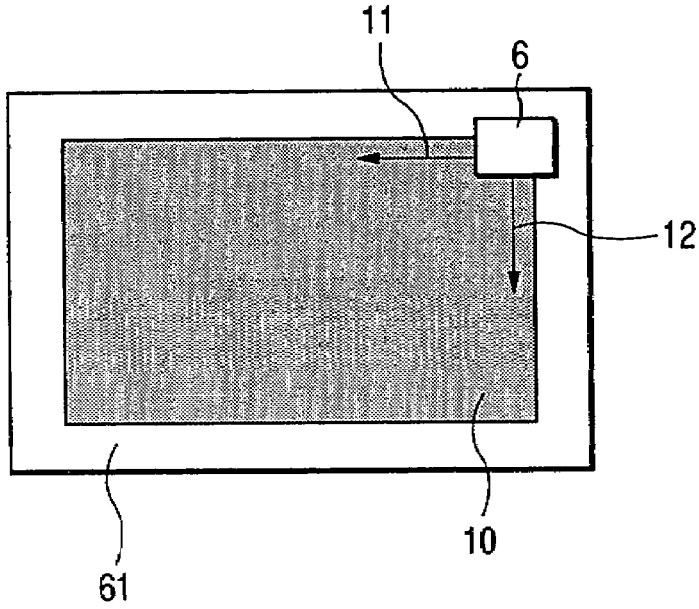
FIG. 3A and FIG. 3B illustrate schematically a state of liquid application by a conventional single head.
Figure 3B:
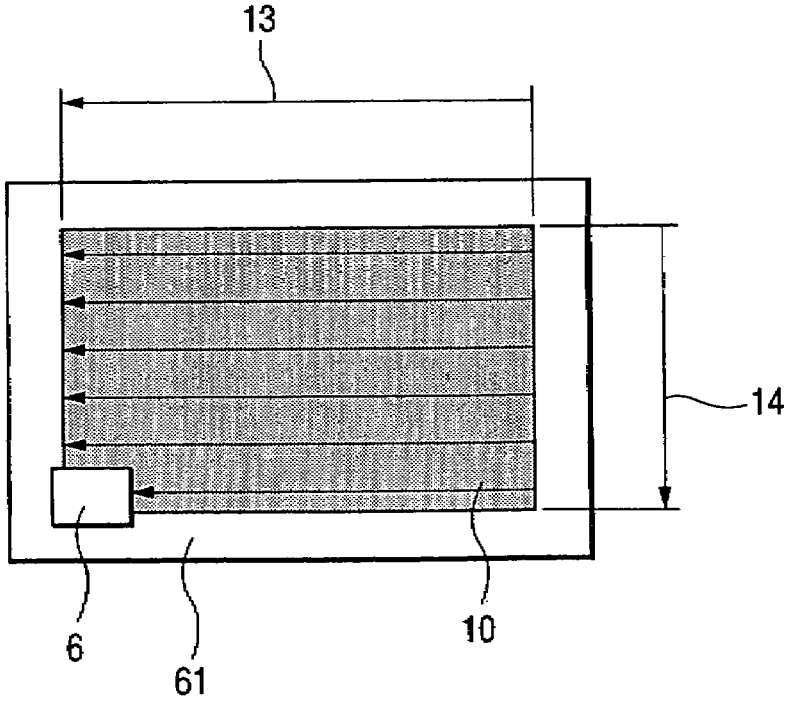

Here, the method for depositing liquids by the use of the four ink jet heads which severally correspond to the four equally divided electron emitting areas will be described below as compared with the conventional method for depositing small substrates by the use of one head with reference to FIGS. 3A, 3B, 4A, and 4B. In the diagrams, 6 denotes an ink jet head. FIGS. 3A and 3B represent the case of relying on one head for effecting the deposition of liquids on the component element parts of an element area 10 owing to the motion of the head located in the upper right of the element part in an X direction 11 and a Y direction 12 relative to the substrate 61 (FIG. 3A). The drive strokes of X and Y produced in this case are indicated by 13 and 14 in FIG. 3B. The deposition was attained by producing motion in the Y direction and meanwhile repeating the scanning in the X direction. The drive was generated by driving the stage on the substrate side.

Figure 4A:
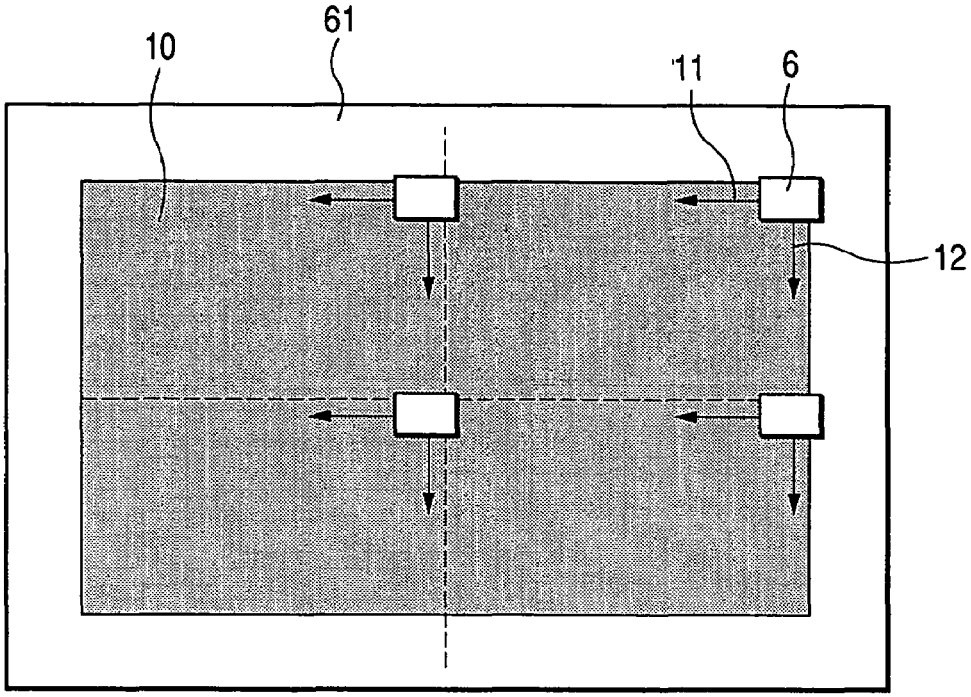
FIG. 4A and FIG. 4B illustrate schematically a state of liquid application on divided regions of the present invention.
Figure 4B:
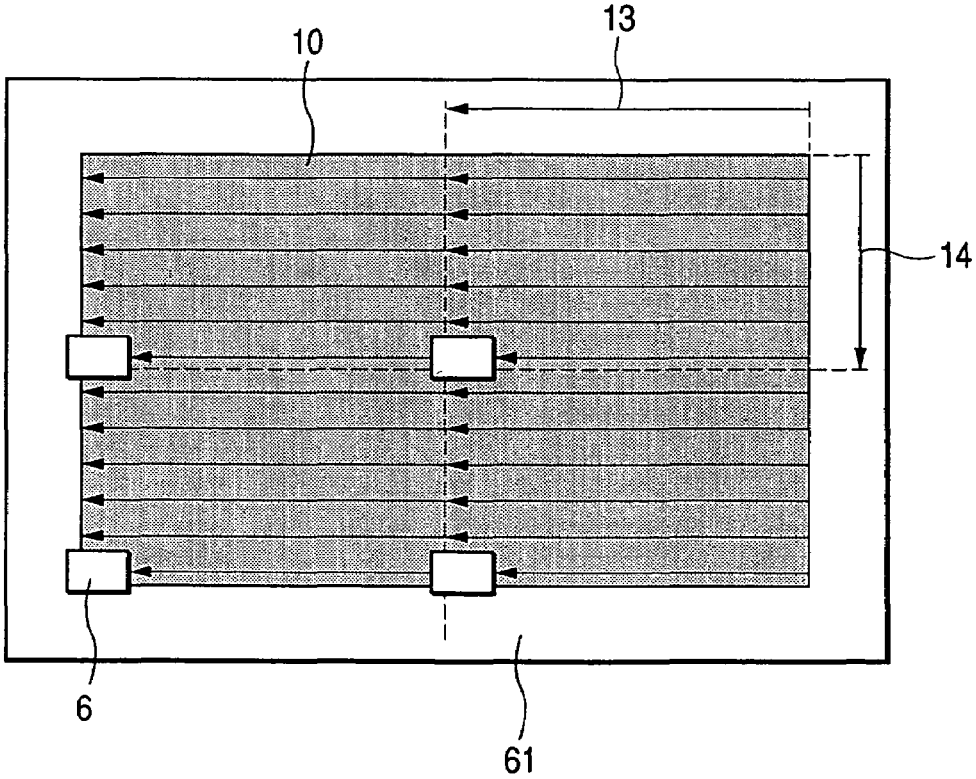

FIGS. 4A and 4B represent an electron source substrate 61 which has an outside size nearly twice that of the substrate of FIGS. 3A and 3B and an element area 10 exactly twice the size of the substrate just mentioned. The element area 10 was equally divided into 2×2, or four, areas. The equally divided areas each corresponded to a total of four ink jet heads. The relative motions between the heads and the substrates in the X direction 11 and the Y direction 12 were equal among the four heads in terms of both drive speed and drive distance.

While the identical relative motions were attainable by driving the head side or the substrate side stage, the present example contemplated driving the substrate side and meanwhile fixing the head side (FIG. 4A).

As a concrete means for driving the stage, the present example adopted a method using an LAB (linear air bearing) for the drive in the X direction and a method using a ball bearing for the drive in the Y direction. The combination of the LAB operating more quickly and more accurately and hence used on the X side with the ball bearing enjoying lower expense and greater ease of handling and hence used on the Y side was elected because the deposition of liquids across the entire surface of the element area was attained by producing a motion in the Y direction and meanwhile repeating a scan in the X direction and the drive in the X side consequently required a drive means capable of operating more quickly and more accurately. It is naturally allowable to adopt the LAB on both the X side and Y side. It is further permissible to adopt the principle of a ball bearing on both sides so long as the functions due on the two sides are fully satisfied.

The present example, as depicted above, used four heads. The positional relation of these four heads which was produced in consequence of the attachment of the heads was adjusted in advance of the deposition of liquids in the element area for the sake of correcting an error possibly committed during the attachment of the heads. In this example, this adjustment was implemented by performing the deposition of liquids outside the element area on the substrate, measuring the positions at which the liquids discharged from the relevant heads landed on the substrate, and adjusting the positions of the heads with reference to the position of one selected head thereby ensuring deposition of liquids at the correct positions.

Since the heads which corresponded to the four equally divided areas as illustrated in FIG. 4B were responsible for the operation of coating the relevant areas, they were capable of coating the four divided areas twice as large in size and four times as large in surface area in the same span of time at entirely the same stroke as the drive strokes 13 and 14 of the conventional single head illustrated in FIG. 3B. Moreover, the drive mechanism used for the conventional drive speed and stroke could be utilized herein in its unmodified form.

All the devices described above were collectively controlled by a CPU. To the CPU for controlling all the devices, the LAB (linear air bearing) and the ball bearing serving the purpose of driving the XY stage were connected via an X-direction drive circuit and Y-direction drive circuit. The ink jet heads were connected via head drive circuits to the CPU. Further, an X side laser length meter and Y side laser length meter for detecting the position of the XY stage were also connected to the CPU and operated to feed the information on the XY position thereto.

The CPU, on acquiring the information regarding the position of the stage from the X side laser length meter and Y side laser length meter, effected deposition of liquids on the relevant elements through the ink jet heads via the head drive circuits while analyzing the information on the position of the stage with reference to the coordinates of the component elements memorized in the CPU. The timing for transmitting a signal to deposit liquids to the heads was decided in due respect of the speed of motion of the stage and the duration of flight of the liquids from the heads to the substrates.

For the gap portions between the element electrodes, four superposed depositions of liquids were sequentially carried out in the same manner as in the conventional conditions. In this case, the duration of the deposition of liquids to one element was the same as in the conventional conditions. The element electrode substrate, after deposition of liquids thereon, was heated for 20 minutes in a firing oven at 350° C. to expel the organic substance. As a result, an electroconductive thin film composed of fine particles of palladium oxide (PdO) was formed on the element electrode part.

The cylinder produced as a result of the firing measured about 100 μm in diameter and 150 Å in film thickness. The final element length was about 100 μm.

By the procedure described above, the deposition of liquids on the large-area substrate possessing an element forming area four times as large as the conventional substrate could be attained by the conventional drive mechanism in the same amount of time as in the conventional conditions.

Further, by applying voltage between the element electrodes 2 and 3 on which the electroconductive thin film had been formed, the electroconductive thin film was given an energization forming treatment and consequently made to form an electron emitting part. This treatment completed the manufacture of an electron source substrate possessed of a group of surface conduction type electron emitting elements.

The large-area electron source substrate manufactured by the method described in Example 1 above was found to possess an electron emitting property on a par with the conventional electron source substrate.

EXAMPLE 2

Figure 7:
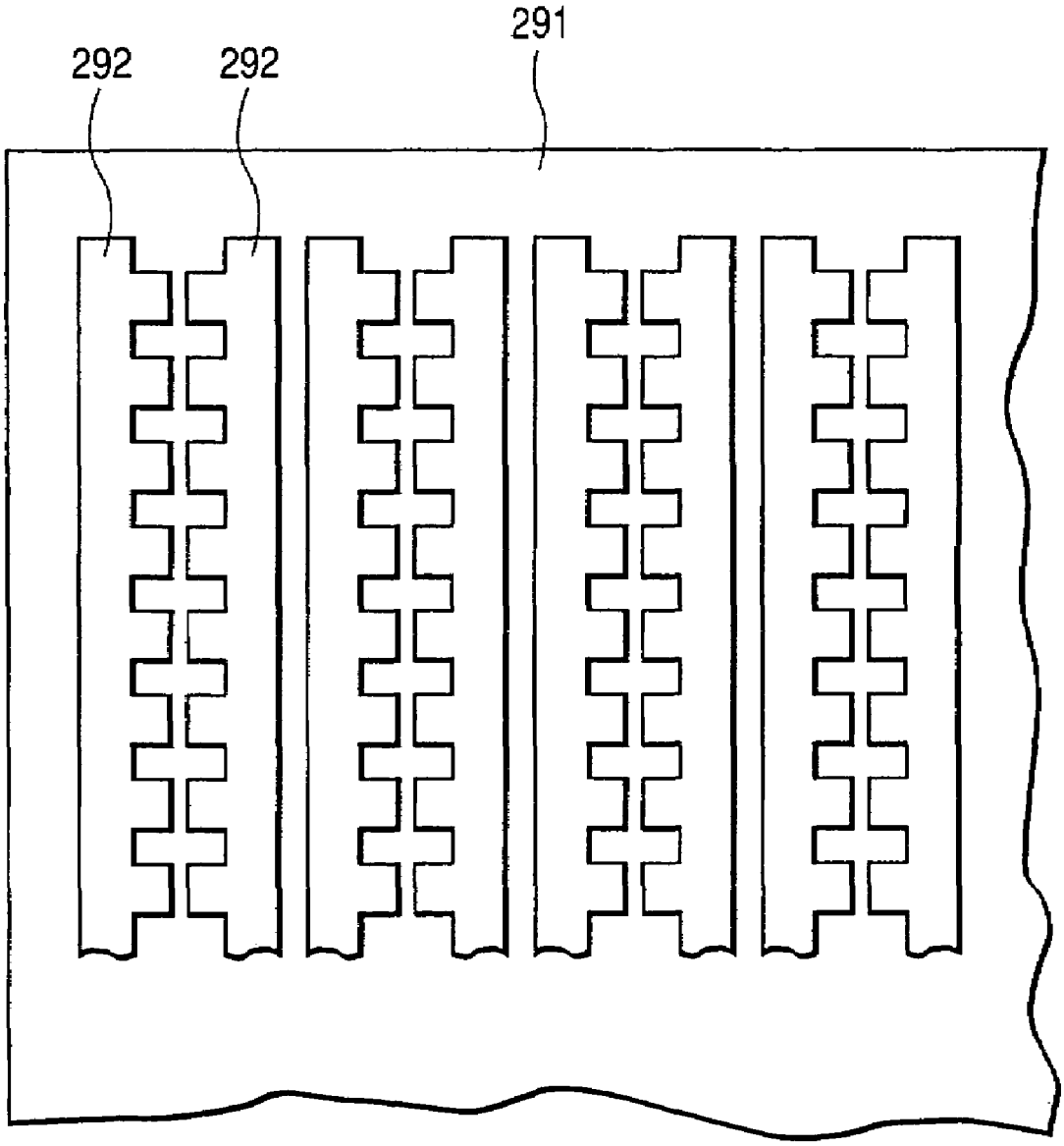
FIG. 7 illustrates schematically an electron source substrate of a ladder arrangement type prepared in Example 2 of the present invention.

Example 2 is meant to illustrate a method for the production of an image forming device provided with a surface conduction type electron emitting element obtained by the method of production contemplated by the present invention. This example used such electrodes as were arrayed in a plurality of columns and connected to wirings after the fashion of a ladder as illustrated in FIG. 7.

The method for the manufacture of the surface conduction type electron emitting element was entirely identical in basic concept with that of Example 1. The principle of equally dividing an electron emitting element area into 2×2, or four, areas and disposing four ink jet heads correspondingly to the equally divided areas as illustrated in FIG. 1 was adopted.

As the raw material for the liquids, the butyl acetate solution of an organic solvent type palladium acetate-bisdipropyl amine complex was used. The ink jet heads were adapted to be operated by the principle of piezzo jet. The aqueous solution of palladium acetate-ethanol amine complex and the ink jet heads of the principle of bubble jet which were used in Example 1 could be used instead herein without any hindrance.

The area twice as large in size and four times as large in surface area could be treated as effectively as in Example 1 by the same drive mechanism and the same amount of time as in the conventional procedure.

Further, by applying voltage between the element electrodes 2 and 3 on which the electroconductive thin film had been formed, the electroconductive thin film was given an energization forming treatment and consequently enabled to form an electron emitting part. This treatment completed the manufacture of an electron source substrate possessed of a group of surface conduction type electron emitting elements.

This electron source substrate was made to form thereon an enveloper 88 with a face plate 86, a supporting frame 82, and a rear plate 81 as illustrated in FIG. 13, vacuum sealed, and then manufactured into an image forming device possessed of a drive circuit for performing television display based on the television signal of the NTSC system as illustrated in FIG. 15.

The large-area image forming device manufactured by the method described in Example 2 above produced an image equal in quality to that obtained by the conventional device across the entire screen which was four times as large.

EXAMPLE 3

The third example of this invention represented a case of manufacturing an electron source substrate by equally dividing a substrate into four areas and disposing ink jet heads each provided with a plurality of nozzles corresponding to the four divided areas in the same manner as in Example 1.

The present example manufactured a total of 1.05 million electron emitting elements in an area of 567 mm×420 mm, with the electron emitting element area having 2100 elements arranged with a pitch of 270 μm in the X direction and 500 elements arranged with a pitch of 840 μm in the Y direction.

In the present example, the electron emitting element area was equally divided into 2×2, namely four, areas and the ink jet heads each possessed of 50 nozzles were disposed so as to correspond to the four divided areas prior to the deposition of liquids in the electron emitting element area. Each of the divided areas had a total of 262500 elements arrayed, i.e. 1050 elements in the X direction and 250 elements in the Y direction. The heads used herein were each possessed of 50 nozzles arranged as spaced with the same pitch of 840 μm as the elements in the Y direction. Therefore, by performing the deposition of liquids while keeping in alignment the direction of arrangement of nozzles in the heads to the Y direction of the substrate, therefore, simultaneous deposition of liquids on 50 elements in the Y direction could be realized in one scan made in the X direction. The positional relation of the four heads which was produced in consequence of the attachment of the heads was adjusted in advance of the deposition of liquids in the element area for the sake of correcting an error possibly committed during the attachment of the heads similarly in Example 1. In this example, since the heads were each possessed of 50 nozzles, the adjustment of the positional relation of the four heads was implemented by measuring the gravitational positions of the dots which were formed when the liquids discharged from the 50 nozzles landed on the substrate and adjusting the positions of the heads with reference to the position of one selected head. In this example, the liquids intended for adjusting the positions of the heads were deposited outside the element area on the substrate. It was permissible, however, to perform exclusive adjustment of the positions of the heads by the use of a separate substrate. The measurement of the gravitational positions of the dots was effected by producing and introducing image data of the positions of the dots by means of CCD and processing the image data thereby computing the positions.

Since the present example relied on the operation of the stage on the substrate side to produce the relative motion between the heads and the substrate similarly in Example 1, the four ink jet heads could be simultaneously moved in one direction relative to the substrate.

The method for driving the stage and the control of timing of the discharge of liquids during the deposition were carried out in the same manner as in Example 1.

The component elements manufactured in the present example had the same construction as described with reference to FIGS. 8A and 8B in the mode of embodiment. The electron source substrate was constructed such that the electrodes of the component elements were connected to the MTX type wiring as illustrated in FIG. 6.

Now, the procedure for the manufacture of the electron source substrate will be briefly described below.

First, a glass substrate was used as an insulating substrate. This glass substrate was thoroughly cleaned with an organic solvent, for example, and then dried in a drying oven at 120° C. On the substrate, as many pairs of electron electrodes each measuring 100 μm in width and separated by a gap of 20 μm as were required for forming a total of 1.05 million elements, with 2100 elements arranged with a pitch of 270 μm in the X direction and 500 elements arranged with a pitch of 840 μm in the Y direction, were formed with a Pt film (500 Å in thickness), and these electrodes were connected to the relevant wirings.

Then, the deposition of liquids was performed on the substrate in the same manner as described above. As the raw material for the liquids, an aqueous solution which was obtained by dissolving in water polyvinyl alcohol in a weight concentration of 0.05%, 2-propanol in a weight concentration of 15%, ethylene glycol in a weight concentration of 1%, and a palladium acetate-ethanol amine complex in a palladium weight concentration of 0.15% was used. For the ink jet heads, the principle of bubble jet was applied. For the gap portions between the element electrodes, four superposed depositions of liquids were sequentially carried out in the same manner as in the conventional conditions. In this case, the interval between the depositions of liquids on one element was set at 2.4 seconds. The element electrode substrate, after having the liquids deposited thereon, was heated for 20 minutes in a firing oven at 350° C. to expel the organic substance and consequently form dots (cylindrical in shape) of electroconductive thin film composed of fine particles of palladium oxide (PdO) on the element electrode part. The dots, after the firing, measured about 100 μm in diameter and 150 Å in thickness. The final length of the element was about 100 μm.

Further, by applying voltage between the element electrodes 2 and 3 on which the electroconductive thin film had been formed, the electroconductive thin film was given an energization forming treatment. Then, this thin film was subjected to an activating and a stabilizing treatment and consequently converted into an electron source substrate.

The electron source substrate manufactured in the present example could be made to form thereon an enveloper with a face plate, a supporting frame, and a rear plate, vacuum sealed, and then manufactured into an image forming device by connecting thereto a drive circuit for performing television display based on the television signal of the NTSC system.

This example was enabled to effect quick and highly accurate deposition of liquids across the entire surface of the substrate because it equally divided the area in which the liquids were destined to be deposited on the electron source substrate into four areas, caused ink jet heads each possessed of 50 nozzles to correspond to the divided areas, and produced by the operation of the substrate a simultaneous motion of all the heads in one direction relative to the substrate.

EXAMPLE 4

Figure 17:
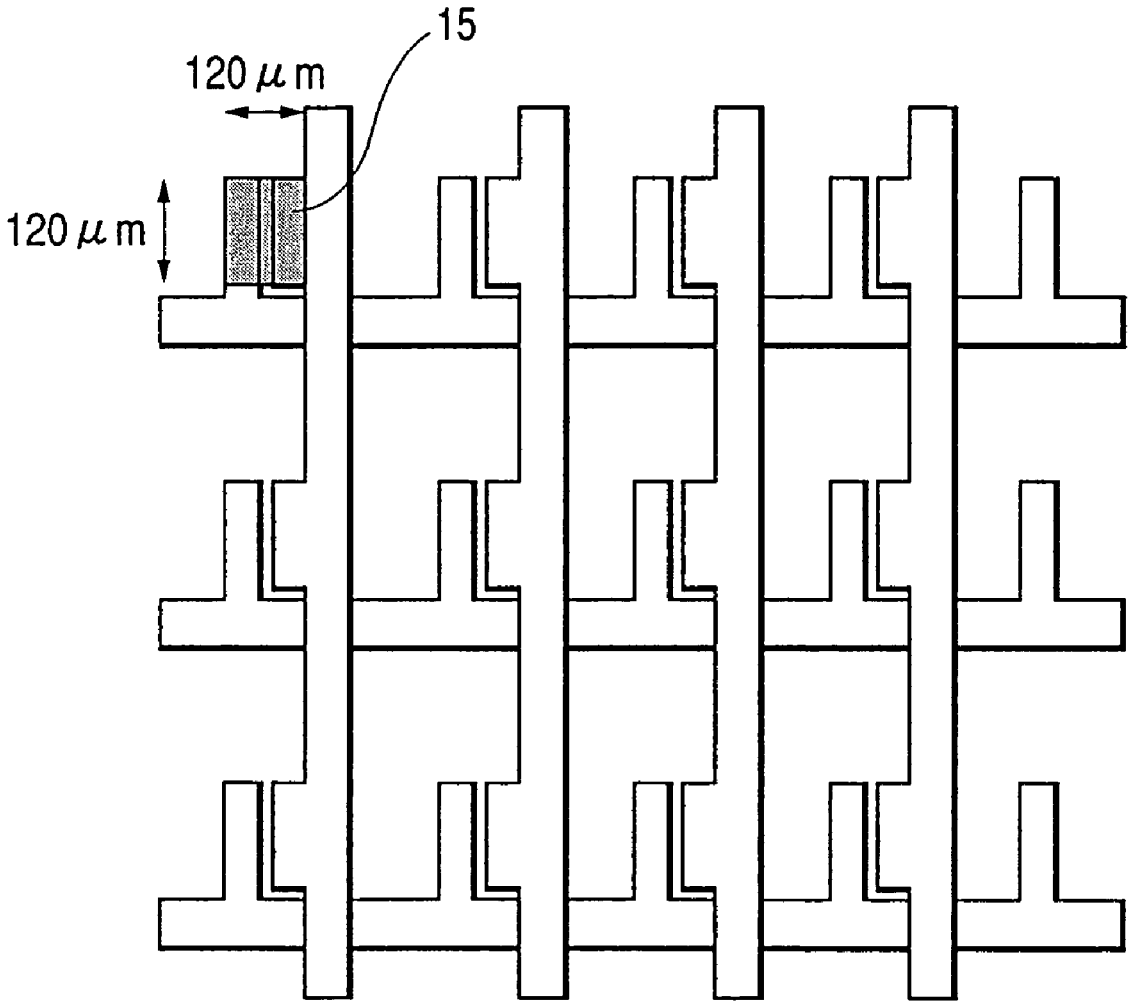
FIG. 17 shows a liquid application sites in electron source substrate of a matrix arrangement type to which the present invention is applied.
Figure 18A:
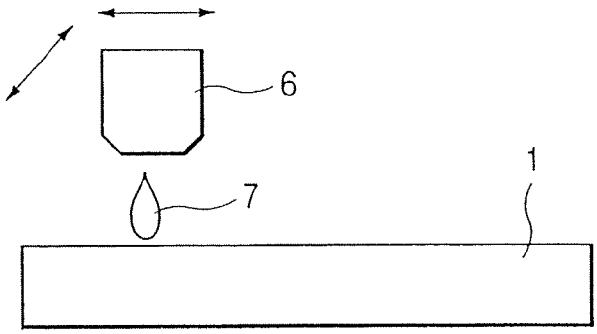
FIG. 18A PRIOR ART
FIG. 18A, FIG. 18B, and FIG. 18C illustrate schematically a state of conventional liquid application.
Figure 18B:
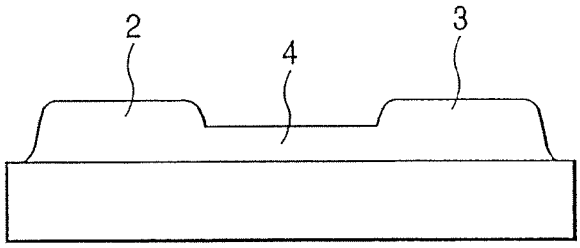
FIG. 18B PRIOR ART
Figure 18C:
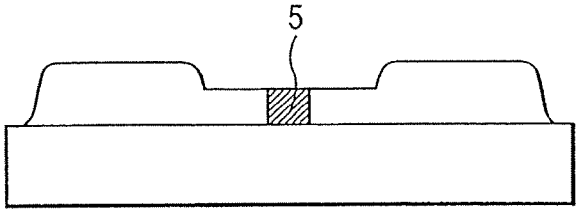
FIG. 18C PRIOR ART
Figure 19:
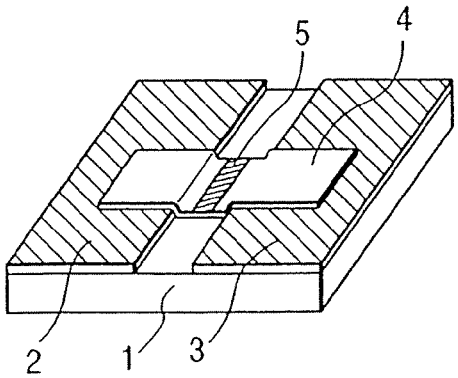
FIG. 19 PRIOR ART
FIG. 19 is a perspective view of a conventional surface conduction type electron-emitting element.
Figure 20:
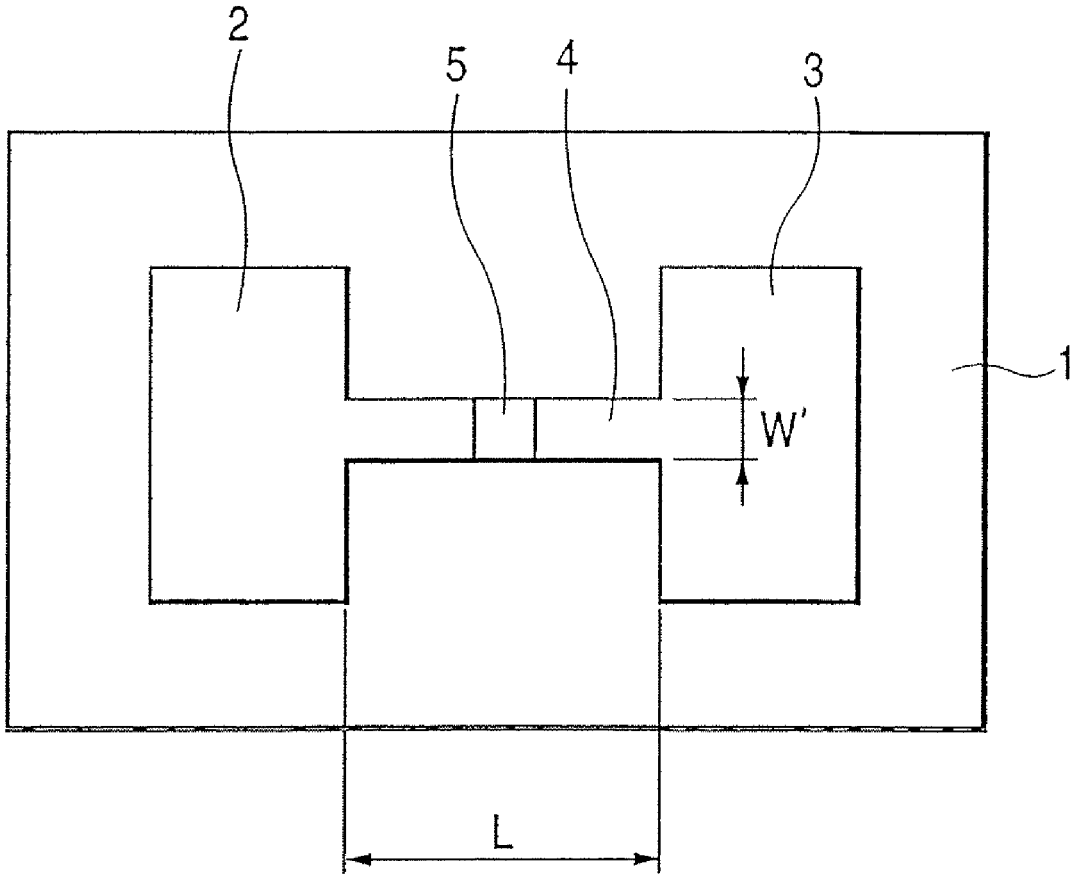
FIG. 20 is a schematic plan view of a conventional surface conduction type electron-emitting element.

On a cleaned soda lime glass, opposed electrodes of Pt film measuring 500 Å in thickness and separated by a gap of 20 μm were arrayed as spaced by 300 μm in the form of matrix, with 100 electrodes arranged in the direction of column and 100 electrodes in the direction of row and the opposed electrodes were severally connected with wirings laid in the direction of column and wirings in the direction of row. In this case, the range in which the electroconductive thin film could be formed (the area which permitted deposition of liquids) was set at 120 μm×120 μm as illustrated in FIG. 17.

The reason for deciding on this particular range was that the dots of liquids deposited through the ink jet heads in use had a diameter of 100 μm, the accuracy with which the liquids landed on targets was about ±5 μm, and the accuracy with which the stage was advanced was about ±5 μm.

When liquids were deposited four times in each of the four equally divided element parts on the substrate mentioned above by using the same ink jet head and solution (the aqueous solution of palladium acetate-ethanol amine complex) as in Example 1, some of the elements obtained by depositing the plurality of liquids at intervals of less than 2 seconds produced dots which were unduly large in diameter and susceptible of disintegration due to contact with a wiring.

In an experiment performed on the samples of the substrate devoid of a wiring, the dots produced were measured for diameter. The results of the measurement are shown in Table 1.

TABLE 1

| Interval, T (sec), of depostion | Diameter of dots (four samples each) (μm) | | | |
|---|---|---|---|---|
| 0.4 | 114 | 110 | 112 | 110 |
| 0.6 | 108 | 110 | 110 | 114 |
| 0.8 | 116 | 110 | 112 | 108 |
| 1.0 | 110 | 114 | 114 | 108 |
| 1.2 | 112 | 108 | 114 | 110 |
| 1.4 | 114 | 108 | 110 | 112 |
| 1.6 | 108 | 106 | 110 | 106 |
| 1.8 | 112 | 108 | 110 | 110 |
| 2.0 | 102 | 100 | 104 | 102 |
| 2.2 | 102 | 100 | 100 | 100 |
| 2.4 | 100 | 102 | 100 | 100 |
| 2.6 | 102 | 100 | 100 | 100 |

The table shows the results of the measurement of diameter obtained of the dots produced on the varying sets of four elements by depositing liquids four times per element part at intervals of T in the environment of a temperature of 23° C. and a humidity of 45%. Incidentally, the dots produced by only one round of the deposition of liquids measured 100 μm in diameter. It is noted from the table that the dots of liquids deposited at intervals not less than 2 seconds had a diameter nearly equal to that of the dots produced by one round of deposition, but that the dots of liquids deposited at intervals not exceeding 1.8 seconds inevitably had a diameter larger than that of the dots produced by one round of deposition. These results support an inference that where the intervals T of deposition do not exceed 1.8 seconds, the substrates provided with the wiring mentioned above have the possibility that the liquids will touch the wiring and consequently the dots will succumb to deformation and the elements in the substrates will show poor distribution of resistance after the firing. In contrast, the present example was enabled to produce electron source substrates whose elements were free from the deformation of dots due to contact of liquids with the wiring and were permitted to acquire uniform resistance distribution after the firing by subjecting the substrates provided with the wiring to deposition of liquids at intervals T not less than 2 seconds. The image display device which used such substrate enjoyed fully satisfactory distribution of luminance in the screen.

Figure 5:
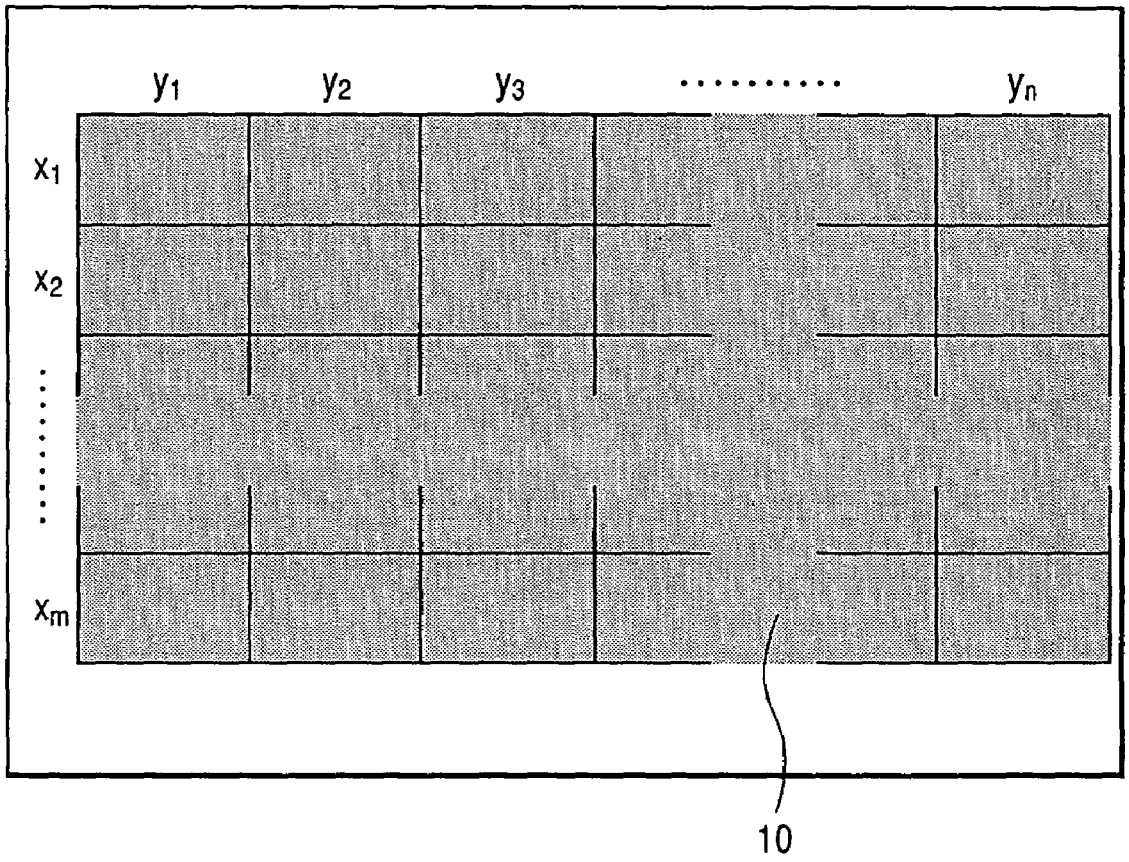
FIG. 5 illustrates element area divided into m×n equal regions.

The example, as depicted above, equally divided the electron emitting element area into 2×2, or four, areas. The present invention, however, allows the manner of this division to be varied arbitrarily depending on the kind of drive, size of substrate, and size of element area to be actually used. For example, this division may be made into m×n areas as shown in FIG. 5 (in which an element area is denoted by 10). While the throughput can be exalted by increasing the numerals, m and n, the deposition of liquids performed on a plurality of rounds per element part demands due care. To form dots which have a diameter equal to that of the dots produced by one round of deposition, the plurality of rounds of deposition must be spaced by an interval exceeding the interval which is decided by the temperature, humidity, and composition of solvent. It is, therefore, preferable to carry out the deposition of an electroconductive thin film by using such number of divisions and pattern as afford the interval mentioned above.

The invention covered by the subject patent application enables the deposition of liquids in the formation of the electroconductive film of an electron emitting element on an electron source substrate to be fulfilled in a short processing time by the use of a convenient drive mechanism as described above. It also allows the deposition of liquids to be performed on a large surface area by the use of a convenient drive mechanism.

Further, the invention covered by the subject patent application can repress the possible deformation of an electroconductive film during the formation of this film.

This invention, therefore, contributes to improve the throughput of the process of manufacture of an electron source substrate and image forming device using a surface conduction type electron emitting element according to this invention and permits realization of a cost cut. It further can provide power sources and image forming devices which enjoy high uniformity and high quality.

What is claimed is:

1. A method of producing a display device comprising a substrate, a plurality of electrodes, and a plurality of film elements arranged on the substrate in a matrix of rows and columns, each of the film elements being disposed between a corresponding pair of the electrodes, the method comprising the steps of:

(A) providing a liquid containing a material for constituting the film elements; and (B) applying the liquid to each of regions where said plurality of film elements are to be formed, at least twice by an ink-jet system, wherein the liquid is applied at an interval of more than 1.8 seconds.

2. The method according to claim 1, wherein at least one of the liquids contains a material is selected from the group consisting of a metal, a polar solvent and an organic solvent.

3. The method according to claim 1, wherein the applying step is conducted by a plurality of ink-jet devices each having a nozzle for ejecting the liquid.

4. The method according to claim 1, further comprising a step of forming at least part of a wiring on the substrate prior to the applying step.

5. A method of producing a display device comprising a substrate, a plurality of electrodes, and a plurality of film elements arranged on the substrate in a matrix of rows and columns, each of the film elements being disposed between a corresponding pair of the electrodes, the method comprising the steps of:

(A) providing a liquid containing a material for constituting the film elements; and (B) applying the liquid to each of regions where said plurality of film elements are to be formed, at least twice by an ink-jet system, wherein the liquid is applied at an interval of more than 2.0 seconds.

6. A method of producing a display device having a plurality of units each comprising a pair of electrodes and a film disposed between the electrodes, the method comprising the steps of:

(A) providing a liquid containing a material for constituting the film; and (B) applying the liquid to each of regions of a substrate where films in said plurality of units are to be formed, at least twice by using an ink-jet system, wherein the liquid is applied at an interval of more than 1.8 seconds.

7. The method according to claim 6, wherein the at least one of the liquids contains a material selected from the group consisting of a metal, a polar solvent and an organic solvent.

8. A method of producing a display device having a plurality of units each comprising a pair of electrodes and a film disposed between the electrodes, the method comprising the steps of:

(A) providing a liquid containing a material for constituting the film; and (B) applying the liquid to each of regions of a substrate where films in said plurality of units are to be formed, at least twice by using an ink-jet system, wherein the liquid is applied at an interval of more than 2.0 seconds.

9. A method of producing a display device having a plurality of units on a substrate, each unit comprising a pair of electrodes and a film disposed between the electrodes, the method comprising the steps of:

(A) applying a first liquid containing material for constituting a first portion of the film to each of regions where films of said plurality of units are to be formed; and (B) applying a second liquid containing material for constituting a second portion of the film to each of regions where the films of said plurality of units are to be formed, by an ink-jet system, wherein in each of the regions, an interval between the step of applying the first liquid and the step of applying the second liquid is more than at least 1.8 seconds.

10. The method according to claim 9, wherein the interval is more than 2.0 seconds.

11. The method according to claim 9, wherein at least one of the first and the second liquid contains a material selected from the group consisting of metal, a polar solvent and an organic solvent.

12. The method according to claim 9, wherein the step of applying the first liquid is conducted by a plurality of ink-jet devices each having a nozzle for ejecting the first liquid.

13. The method according to claim 9, further comprising a step of forming at least part of a wiring on the substrate prior to at least one of the applying steps.

14. The method according to claim 9, wherein the step of applying the first liquid is conducted by an ink-jet system.

15. A method of producing a display device having a plurality of units on a substrate, each unit comprising a pair of electrodes and a film disposed between the electrodes, the method comprising the steps of:

(A) applying a first liquid containing material for constituting a first portion of the film to each of regions where films of said plurality of units are to be formed; and (B) applying a second liquid containing material for constituting a second portion of the film to each of regions where the films of said plurality of units are to be formed, by an ink-jet system, wherein in each of the regions, an interval between the step of applying the first liquid and the step of applying the second liquid is more than at least 1.8 seconds.

16. The method according to claim 15, wherein the interval is more than 2.0 seconds.

17. The method according to claim 15, wherein at least one of the first and the second liquids contains a material selected from the group consisting of a metal, a polar solvent and an organic solvent.

18. The method according to claim 15, further comprising a step of forming at least part of a wiring in the substrate prior to at least one of the applying step.

19. A method of producing a display device having a unit comprising a pair of electrodes and a film disposed between the electrodes on a substrate, the method comprising the steps of:

(A) applying a first liquid containing material for constituting a first portion of the film to a region where the film of the unit is to be formed; and (B) applying a second liquid containing material for constituting a second portion of the film to the region where the film of the unit is to be formed, by an ink-jet system, wherein in the region, an interval between the step of applying the first liquid and the step of applying the second liquid is more than at least 1.8 seconds.

20. The method according to claim 19, wherein the interval is more than 2.0 seconds.

21. The method according to claim 19, wherein at least one of the first and the second liquids contain a material selected from the group consisting of a metal, a polar solvent and an organic solvent.

22. The method according to claim 19, further comprising a step of forming at least part of a wiring in the substrate prior to at least one of the applying steps.

* * * * *